US008240765B2

(12) United States Patent
Kennedy et al.

(10) Patent No.: US 8,240,765 B2
(45) Date of Patent: Aug. 14, 2012

(54) CHILD CHAIR

(75) Inventors: Brook Kennedy, Glen Ridge, NJ (US); Jonathan Cedar, Brooklyn, NY (US); Colin Kelly, Brooklyn, NY (US); Troy Phipps, Brooklyn, NY (US); Ryan Vernon, New York, NY (US); Nicholas Oxley, New York, NY (US); Eric Freitag, New York, NY (US)

(73) Assignee: Helen of Troy Limited, St. Michael (BB)

( * ) Notice: Subject to any disclaimer, the term of this patent is extended or adjusted under 35 U.S.C. 154(b) by 273 days.

(21) Appl. No.: 12/584,727

(22) Filed: Sep. 11, 2009

(65) Prior Publication Data

US 2011/0062753 A1 Mar. 17, 2011

(51) Int. Cl.
*A47C 3/20* (2006.01)
*A47B 83/02* (2006.01)

(52) U.S. Cl. ... 297/338; 297/151; 297/153; 297/423.38; 297/467

(58) Field of Classification Search ..... 297/151, 297/153, 170, 256.11, 338, 423.38, 467
See application file for complete search history.

(56) References Cited

U.S. PATENT DOCUMENTS 1,401,834 A * 12/1921 Tretter ..... 297/383
1,556,622 A 10/1925 Meharey
2,461,123 A * 2/1949 Miller ..... 297/138
2,532,812 A * 12/1950 Huber ..... 297/149
2,538,231 A * 1/1951 Booth ..... 297/338
2,851,084 A 9/1958 Benjetsky
3,037,813 A * 6/1962 Lowe ..... 297/467
3,930,214 A * 12/1975 Richards et al. ..... 337/72
4,221,430 A 9/1980 Frobose
4,342,483 A 8/1982 Takada
4,582,359 A 4/1986 Wise et al.
4,655,506 A 4/1987 Wise et al.
4,723,813 A * 2/1988 Kassai ..... 297/153
4,738,489 A 4/1988 Wise et al.
4,819,988 A 4/1989 Hellstrom
4,826,246 A 5/1989 Meeker
4,854,638 A * 8/1989 Marcus et al. ..... 297/256.11
4,880,277 A 11/1989 Takahashi et al.
4,944,556 A * 7/1990 Griesbaum et al. ..... 297/423.38
4,968,092 A * 11/1990 Giambrone ..... 297/151
5,061,012 A 10/1991 Parker et al.
5,082,325 A 1/1992 Sedlack
5,161,522 A * 11/1992 Clevenger ..... 601/24
5,238,292 A 8/1993 Golenz
5,286,086 A 2/1994 Gunji
5,348,374 A 9/1994 Kuo (Continued)

OTHER PUBLICATIONS

International Search Report and Written Opinion dated Dec. 15, 2010 re PCT/US10/47098.

(Continued)

*Primary Examiner* — David Dunn
*Assistant Examiner* — David E Allred

(57) ABSTRACT

A child's chair is disclosed having, in its most basic form, a frame having four legs, a seat having a bottom support and a back support, and a tray. To these basic components, numerous modifications can be made to customize features of the chair for enhancing safety and convenience, and/or adapting to additional possible uses. Each of the disclosed embodiments includes at least one of either an adjustable seat, an adjustable footrest, a center post mounted tray, a multiple position, single-hand adjustable tray, a concealed release button, and any combination of such features.

18 Claims, 40 Drawing Sheets

U.S. PATENT DOCUMENTS 5,375,894 A * 12/1994 Schlack ..... 292/36
5,445,432 A 8/1995 Chien
D362,554 S * 9/1995 Grundner ..... D6/339
D362,971 S 10/1995 Pacheco
5,489,138 A 2/1996 Mariol et al.
5,509,719 A 4/1996 Cone, II
D369,911 S 5/1996 Turner
5,527,090 A 6/1996 Cone, II
5,558,400 A 9/1996 Poulson et al.
5,560,680 A 10/1996 Salvador et al.
5,580,126 A * 12/1996 Sedlack ..... 297/256.15
5,673,969 A 10/1997 Frazier
5,690,382 A 11/1997 Cone
5,779,319 A 7/1998 Merrick
5,823,615 A 10/1998 Haut
5,951,102 A 9/1999 Poulson et al.
5,992,932 A * 11/1999 Kain et al. ..... 297/153
6,024,412 A 2/2000 Kain et al.
6,050,643 A * 4/2000 Kain et al. ..... 297/344.18
D426,965 S 6/2000 Wu
6,082,814 A 7/2000 Celestina-Krevh et al.
6,089,653 A 7/2000 Hotaling et al.
6,089,661 A * 7/2000 .ANG.strom ..... 297/237
6,126,236 A 10/2000 Wu
6,196,629 B1 3/2001 Onishi et al.
6,247,755 B1 6/2001 Canna et al.
6,260,925 B1 7/2001 Miller
6,416,124 B1 * 7/2002 Chen et al. ..... 297/149
6,454,350 B1 9/2002 Celestina-Krevh et al.
6,481,794 B1 11/2002 Kassai et al.
6,511,123 B1 1/2003 Sitarski et al.
6,540,301 B1 * 4/2003 Bottoms ..... 297/423.11
6,659,564 B2 12/2003 Kassai et al.
6,715,783 B1 4/2004 Hanson et al.
6,719,371 B2 4/2004 Yoshie et al.
6,746,080 B2 6/2004 Tsugimatsu et al.
D493,965 S 8/2004 Kuester
6,811,216 B2 11/2004 Sedlack
6,893,088 B2 * 5/2005 Kassai et al. ..... 297/250.1
6,951,371 B2 10/2005 Wang
D517,336 S * 3/2006 Engelstad ..... D6/367
7,029,064 B2 * 4/2006 Chen ..... 297/16.1
7,066,542 B2 6/2006 Wang
7,077,475 B2 7/2006 Boyle
7,086,695 B2 * 8/2006 Hosoya ..... 297/256.16
7,104,603 B2 9/2006 Keegan et al.
7,237,840 B2 * 7/2007 Furui ..... 297/256.1
7,331,629 B2 2/2008 Knaven
7,387,337 B2 6/2008 Keegan et al.
7,419,210 B2 9/2008 Nolan et al.
7,445,286 B2 11/2008 Siewertsen et al.
7,568,758 B2 8/2009 Troutman et al.
7,673,940 B2 * 3/2010 Fritz et al. ..... 297/256.11
7,735,911 B2 * 6/2010 Chen ..... 297/16.1
7,744,163 B2 * 6/2010 Opsvik ..... 297/467
2007/0145790 A1 * 6/2007 Ventrola ..... 297/151
2008/0179922 A1 7/2008 Troutman et al.
2009/0045656 A1 2/2009 Chen et al.
2009/0050162 A1 * 2/2009 Turner et al. ..... 128/898
2009/0134689 A1 * 5/2009 Opsvik ..... 297/467
2009/0206226 A1 * 8/2009 Forrest et al. ..... 248/354.6
2010/0052383 A1 * 3/2010 Merritt ..... 297/250.1

OTHER PUBLICATIONS

Stokke, Tripp Trapp User Guide, Nov. 2009.

* cited by examiner

CHILD CHAIR

TECHNICAL FIELD OF THE INVENTION

The present device relates to a chair for children, such as highchairs and booster seats. Particularly, the present device relates to a child's chair with adjustable components.

BACKGROUND OF THE INVENTION

Highchairs and booster seats have been around for a very long time, with the primary purpose of providing a raised seating surface for babies, toddlers and small children. Initially, only the seat was raised to bring the child to the level of, for example, the dinner table. A removable eating tray soon became a useful attachment, making the improved highchair or booster a stand alone child feeding station and a "must-have" for every expecting household.

Typically, these chairs were a "one-size-fits-all" facility. A child could be fed away from the dinner table with little supervision and less disruption to the rest of the dining family. The eating tray could be removed for easy cleanup and an adjustable waist strap—much like a seat belt—became useful for keeping smaller children from intentionally or unintentionally slipping down out of the chair.

As children's chairs improved, softer, washable materials were used, corners were rounded, and other safety and convenience features were added. However, none of the known prior art chairs addresses each and every one of the problems resolved by the invention of this application. The present child's chair provides quick and convenient adjustability of several components, a simple design and operation, and is adaptive for multiple uses.

SUMMARY OF THE INVENTION

There is disclosed herein a number of embodiments of an improved chair which avoids the disadvantages of prior devices while affording additional structural and operating advantages.

In a first embodiment, a highchair for seating a child is described. The highchair comprises a seat having a bottom support and a back support, the bottom support including a fixed center post extending there from, a frame attached to and supporting the seat at a height, the bottom support of the seat being adjustable between a plurality of fixed positions channels on the frame, and a tray detachably coupled only to the center post of the seat.

In a second embodiment, the highchair includes a seat having a bottom support and a back support, the bottom support including a fixed center post extending there from, a frame attached to and supporting the seat at a height, and a tray having a locking mechanism on a bottom surface for adjustably coupling at a position to the center post of the seat, wherein the position, including removal of the tray, on the center post is adjustable via manipulation of a single release mechanism fixed to the tray and coupled to the locking mechanism.

A third embodiment of the disclosed highchair includes a seat having a bottom support and a back support, the bottom support including a fixed center post extending there from, a frame comprising a plurality of fixed seat position channels and a plurality of fixed footrest position channels, wherein the frame supports the bottom support in a first seat position channel and a footrest is a first footrest position channel and the bottom support of the seat and the footrest are independently adjustable between the seat position channels and the footrest position channels, respectively, and a tray detachably coupled to the center post of the seat.

In a fourth embodiment, the highchair includes a seat having a bottom support and a back support, the bottom support including a fixed center post extending there from, a frame attached to and supporting the seat at a height, a harness for securing a child positioned in the seat, the harness being secured to the seat and adjustable for various sizes at a position adjacent a rear surface of the back support, and a tray detachably coupled to the center post of the seat.

In a fifth embodiment, the highchair comprises a seat having a bottom support and a back support, the bottom support including a fixed center post extending there from, a tray detachably coupled to the center post of the seat, a tray latching mechanism for connecting the tray to the center post and capable of movement between a first connecting position, a second connecting position and a release position, a frame supporting the seat at a first position and having a footrest supported at a second position on the frame, wherein the bottom support of the seat and the footrest are independently adjustable between a plurality of fixed seat position channels on the frame and a plurality of fixed footrest position channels on the frame, respectively, and a harness for securing a child positioned in the seat, the harness being secured to the seat and adjustable for various sizes at a position adjacent a rear surface of the back support.

Still, a sixth embodiment of the highchair comprises a seat having a bottom support and a back support, a frame supporting the seat at a first position and having a footrest supported at a second position on the frame, wherein the bottom support of the seat and the footrest are independently adjustable between a plurality of fixed seat position channels on the frame and a plurality of footrest position channels on the frame, respectively, a tray detachably coupled to the seat, a tray latching mechanism for connecting the tray to the seat and capable of movement between a first connecting position, a second connecting position and a release position, and a harness for securing a child positioned in the seat, the harness being secured to the seat and adjustable for various sizes at a position adjacent a rear surface of the back support.

In a seventh embodiment, a child seat is disclosed which comprises a seat having a bottom support and a back support, a frame having a plurality of fixed seat position channels each configured to retain the bottom support therein, wherein the bottom support of the seat is vertically adjustable relative to the back support via the seat position channels, and a seat latching mechanism for retaining the seat at any of the fixed seat position channels. In such an embodiment the seat latching mechanism comprises a slide bar positioned to intersect each of the fixed seat position channels and capable of movement along an axis between a lock position and a release position, wherein the seat is locked in a channel when the slide bar is at the lock position and the seat is removable from a channel when the slide bar is at the release position, and a button attached to an end of the slide bar and which moves along an axis, transverse to the axis of the slide bar, between a first and second position, wherein the slide bar is prevented from movement when the button is in the first position and is slidable between the slide bar lock and release positions when the button is in the second position.

In still another embodiment, a chair comprises a seat having a bottom support and a back support, a frame supporting the seat, a tray detachably coupled to the seat, and a tray latching mechanism for connecting the tray at a latching point to one of either the seat and the frame and the latching mechanism being adjustable between three settings. The three settings of the tray latching mechanism comprise a locked setting where the tray is secured at the latching point and prevented from movement, an adjust setting where the tray is secured and capable of sliding movement between a plurality of latching points, and a release setting where the tray is released from attachment. Preferably, the tray latching mechanism comprises an actuator for moving the latching mechanism between the three settings.

These and other embodiment and aspects of the invention may be understood more readily from the following description and the appended drawings.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF PREFERRED EMBODIMENTS

Figure 1:
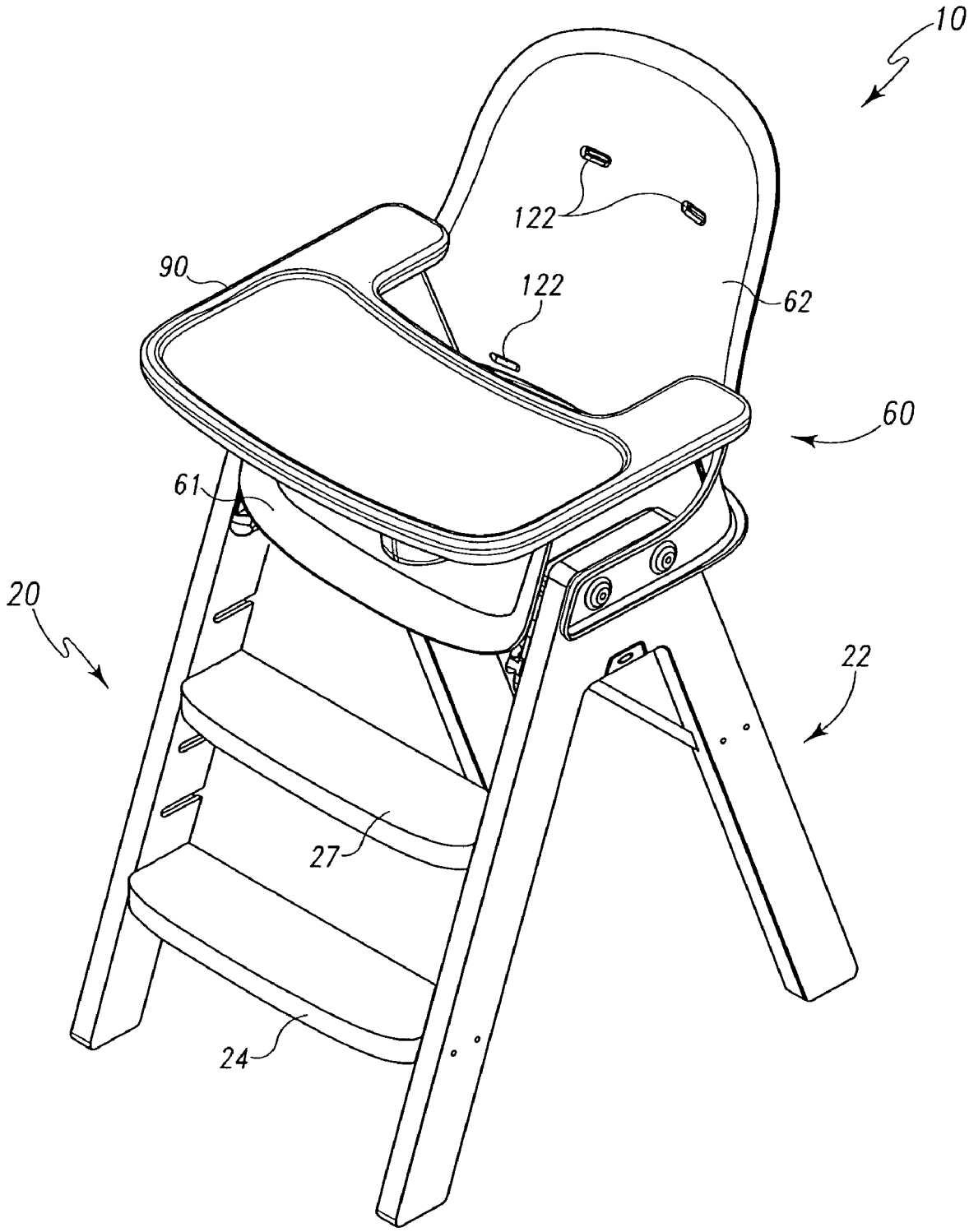
FIG. 1 is a perspective view showing an embodiment of the highchair of the present invention.
Figure 2:
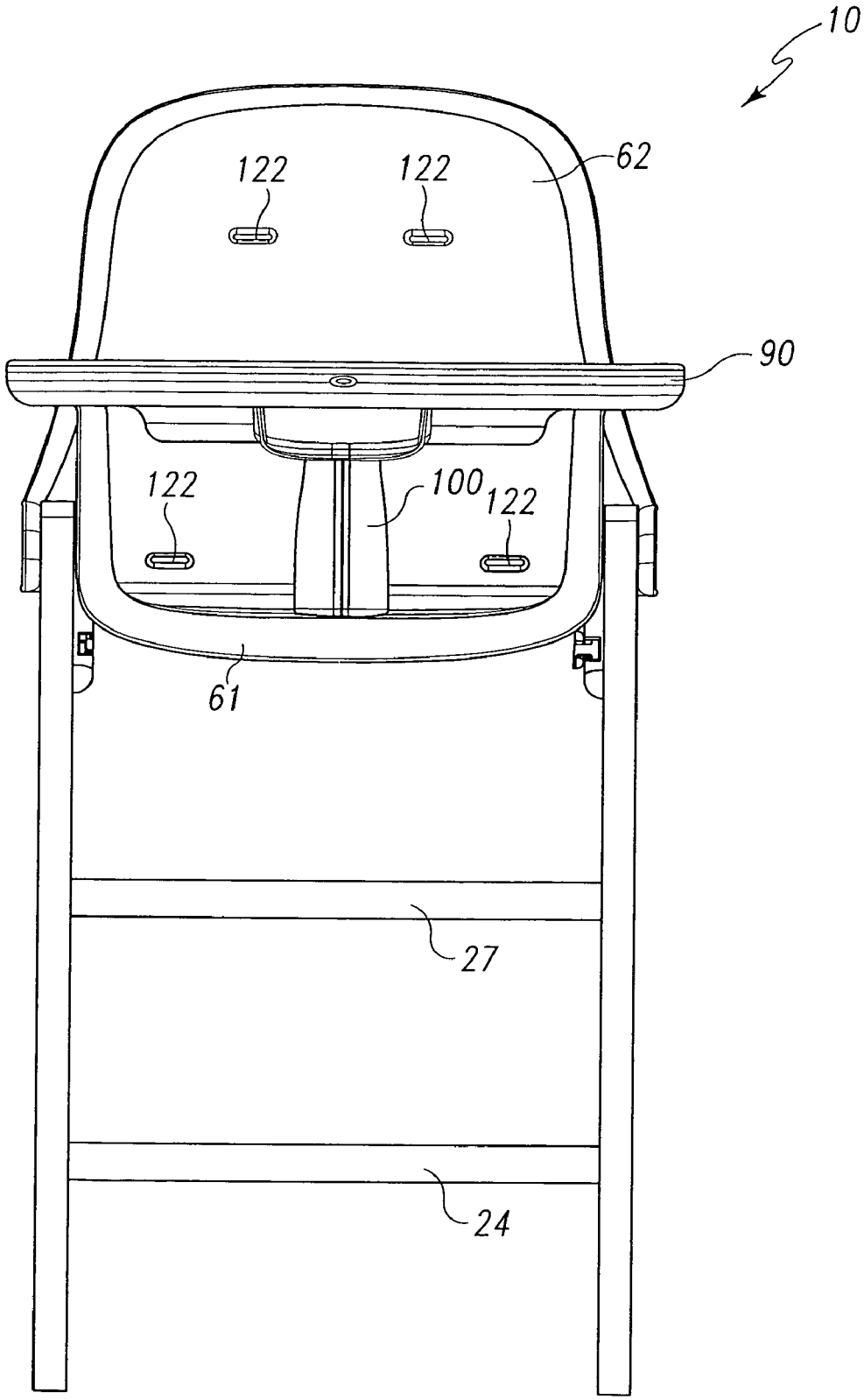
FIG. 2 is a front elevation view of the highchair of FIG. 1.
Figure 3:
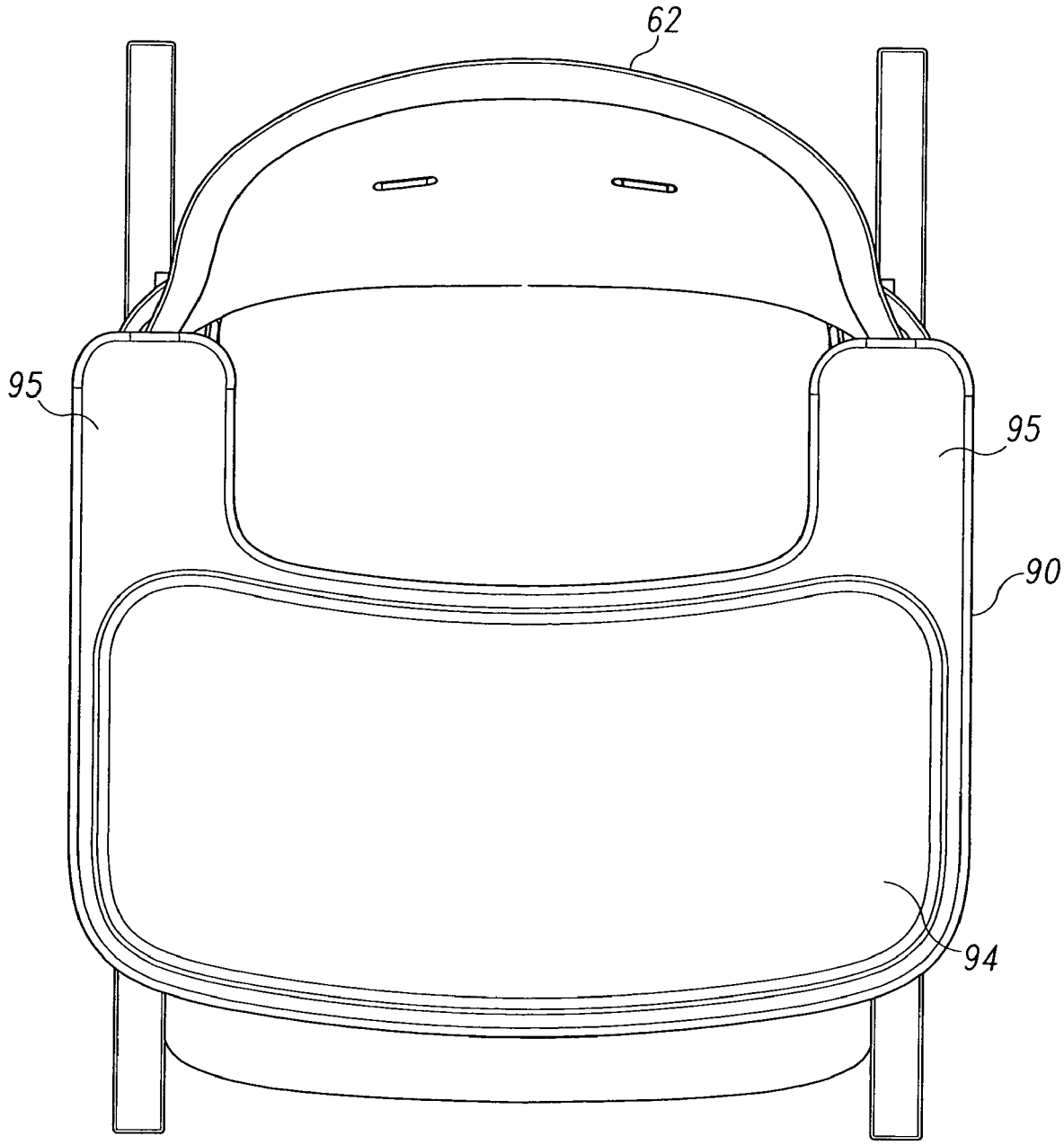
FIG. 3 is a top plan view of the highchair of FIG. 1.
Figure 4:
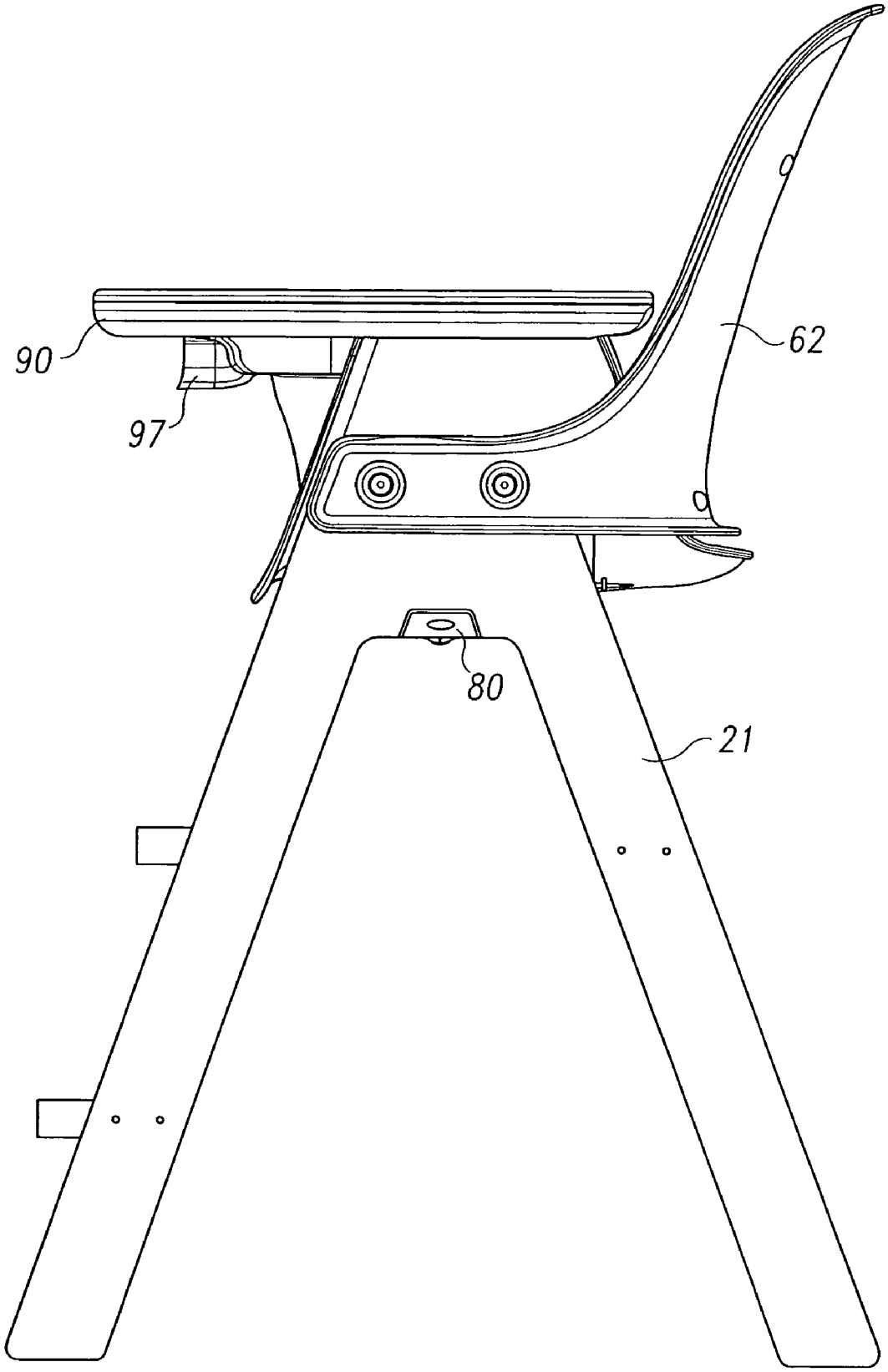
FIG. 4 is a side elevation view of the highchair of FIG. 1.

While this invention of this application is susceptible of embodiments in many different forms, there is shown in the referenced appended drawings and will herein be described in detail, a preferred embodiment of the invention with the understanding that the present disclosure is to be considered as an exemplification of the principles of the invention and is not intended to limit the broad aspect of the invention to embodiments illustrated.

Referring to FIGS. 1-39, there is illustrated multiple embodiments and numerous features and components of a highchair, which is generally designated in the following disclosure and appended drawings by the numeral 10. In its most basic form, the highchair 10 includes a frame 20 having four legs 22, a seat 60 having a bottom support 61 and a back support 62, and a tray 90. However, to these basic components, numerous modifications can be made to customize features of the highchair as will be discussed herein and with the understanding that each can modification and customization can be added to the basic chair 10 for enhancing safety and convenience, and/or adapting to additional possible uses.

Frame

Referring to FIGS. 1-5, the basic highchair frame 20 can be more readily understood. The frame 20 is comprised of two upside-down V-shaped members 21 spaced apart and connected via a rear frame support 23 and a front frame support 24. These supports 23 and 24 are preferably fixed to the members 21 by nails, screws, adhesive or the like, and provide stability to the chair frame 20. A notch 25 within the frame members 21 with a corresponding tab or extension 26 on each side of the support 23 and 24 is helpful in properly positioning the support 23 and 24 between the two members 21. The front support 24 may also provide a step to assist climbing into and out of the highchair 10.

Additional stability is provided to the frame 20 by a footrest 27 which is also positioned between the two V-shaped members 21 just above the front frame support 24. The footrest 27 is similar in appearance to the front support 24, but is distinguishable in that it may be adjusted along the height of the frame 20. FIG. 1 shows a plurality of fixed footrest position channels 28 on the inside surface of the front legs of the frame 20. The footrest position channels 28 are open to the inside of the V-shaped members 21 and terminate before the outside edge to create a stop 30. A corresponding protuberance 29 (FIG. 5) on each end of the footrest 27 allows the footrest 27 to be positioned at each of the channels 28 by sliding the protuberance 29 into the open side of a channel 28 until the stop 30 prevents further insertion.

While four (4) footrest position channels 28 are shown in the embodiment of FIG. 1, each equidistantly spaced from adjacent channels, a different number of such channels could customize the range of adjustability required—e.g., the embodiment of FIG. 6 has only three (3) footrest position channels 28. The protuberances 29 may be sized so as to create a friction fit within the channel 28 or a conventional locking mechanism (not shown) may be used to lock the footrest 27 into a channel 28 once it is correctly positioned.

Of course, the footrest 27 may be fixed to the V-shaped members 21 much as the front support 24 is fixed within the frame 20.

At the top of the frame 20, a chair side panel 70 is attached to each of the V-shaped members 21. The side panels 70 are preferably fixed to the members 21 by screws or bolts. The side panels 70 are relevant to the use and operation of the seat 60 which is discussed in greater detail below.

Seat

Figure 5:
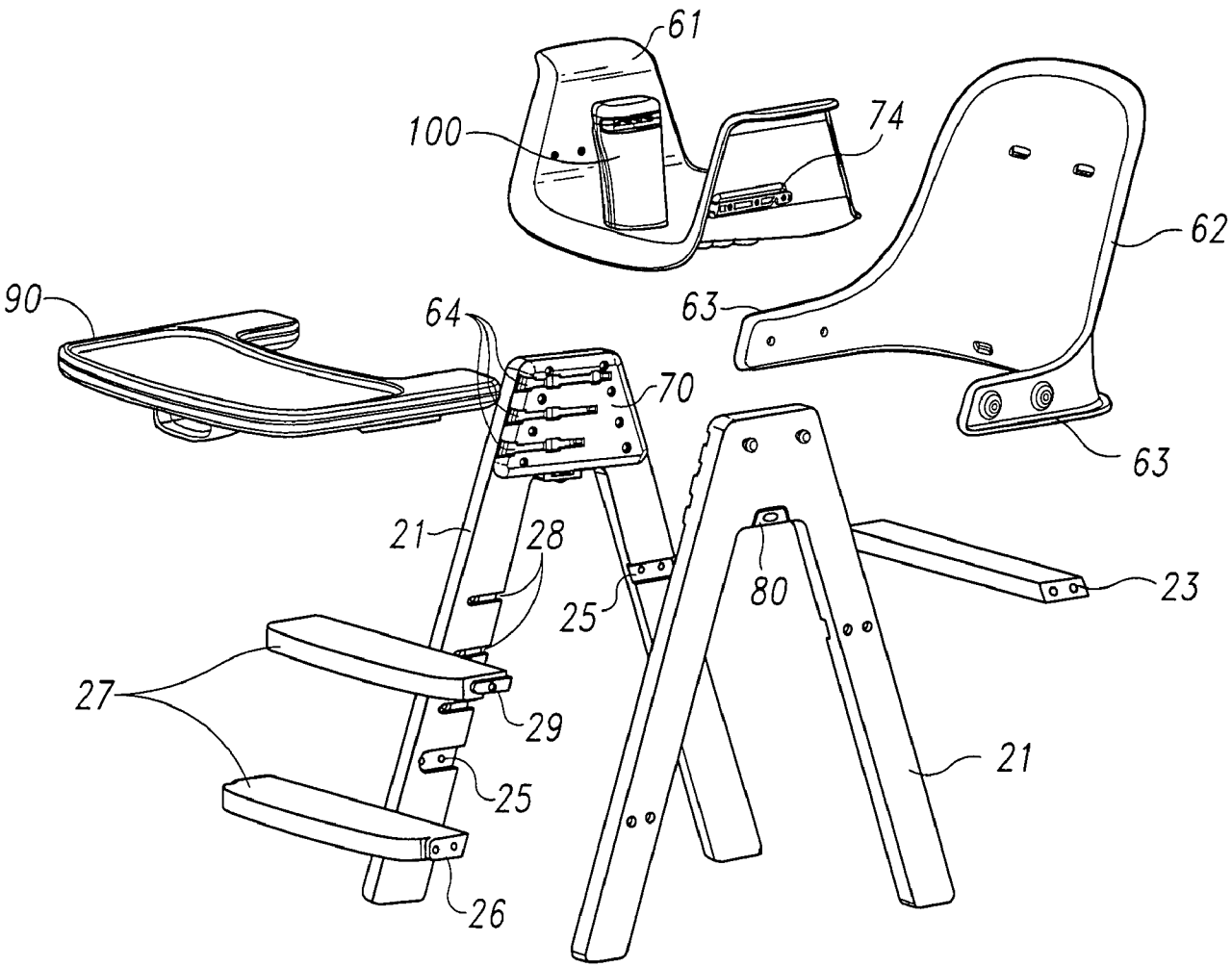
FIG. 5 is an exploded view of the highchair of FIG. 1.

Referring to FIG. 5, further stability is provided to the frame 20 by the adjustable seat 60. The seat 60 is preferably comprised of two individual supports—i.e., bottom support 61 and back support 62. In certain embodiments the two supports may be a unitary or single-piece design (not shown). However, the back support 62 is preferably stationary within the frame 20, fixed by side flanges 63 to the sides of the frame 20 at the top of the V-shaped members. Conversely, the bottom support 61 is preferably vertically adjustable to accommodate different sized children.

Figure 10:
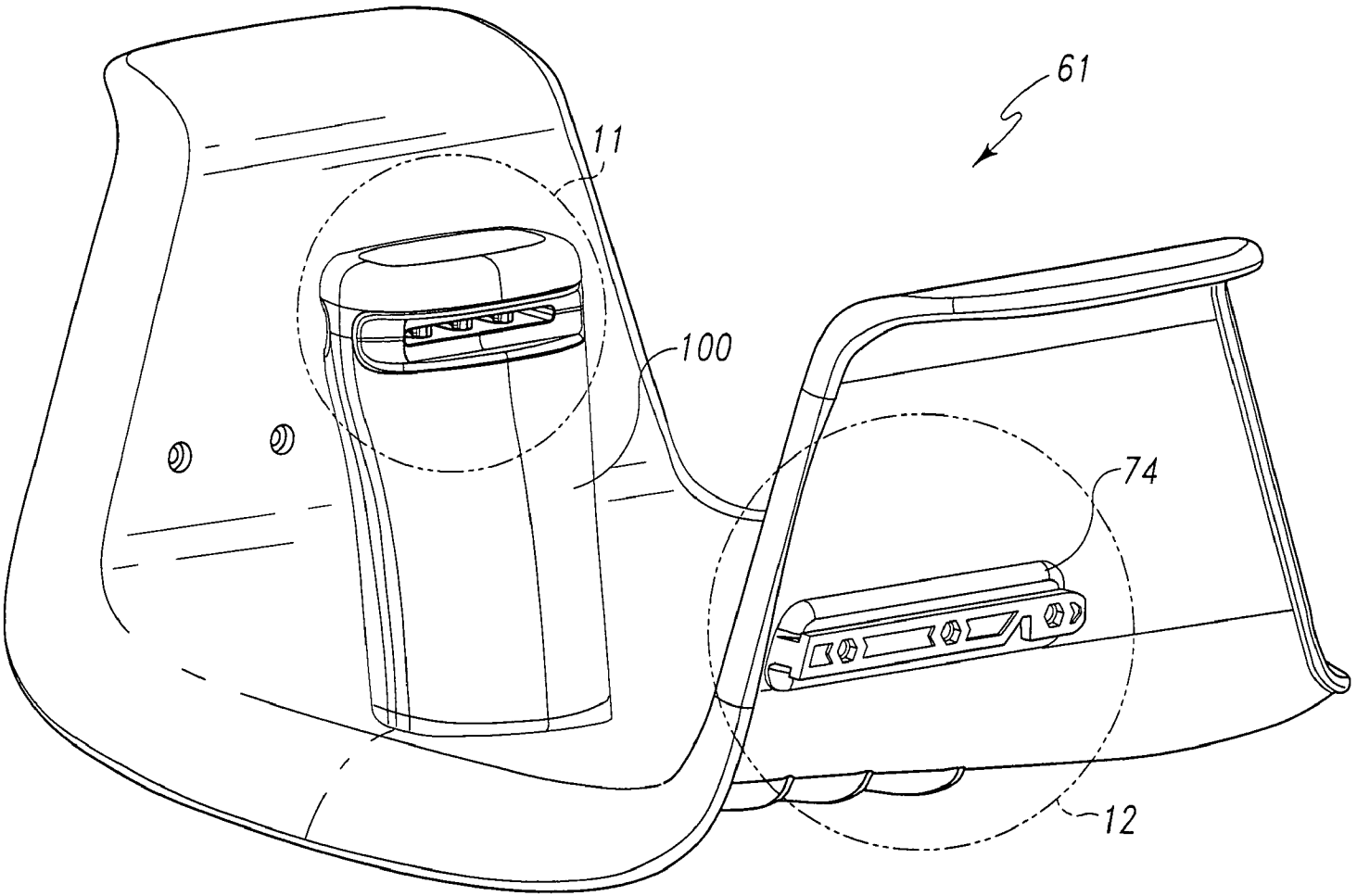
FIG. 10 is a perspective view of an embodiment of a bottom support of the present invention.
Figure 12:
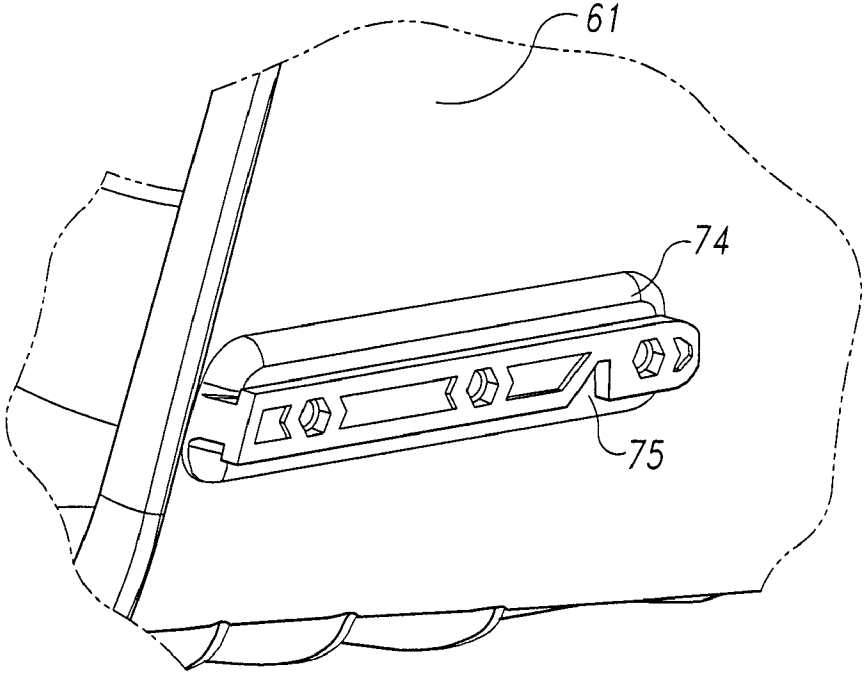
FIG. 12 is a close-up view showing detail of the T-track of FIG. 10.

As shown in FIGS. 5 and 10, the bottom support 61 of the seat 60 is a U-shaped component which when positioned properly with the back support 62 creates a secure and comfortable seat on the chair 10. As mentioned, the bottom support 61 is adjustable and can be secured into any one of a plurality of fixed seat position channels 64 found on a chair side panel 70 attached to an inside surface of the chair frame 20. The channels 64, of which there are shown to be three (3), are preferably vertically spaced from one another in an equidistant manner. Certainly more or less channels 64 can be employed on the panels 70 for altering the degree of seat adjustability.

Referring to FIGS. 5-9, the features of the side panels 70 are illustrated more clearly. A panel 70 is fixed onto each of an inside surface of each of the V-shaped members 21. The panel 70 is shown to be trapezoidal, but is preferably shaped and sized to match the upper frame contour. Each panel 70 is comprised of a first surface 71 having three position channels 64 thereon and a second surface 72 opposite the first surface 71 and abutting the frame 20 for attachment. At least one of the side panels 70 should include a slide bar channel 73 created between the abutting second surface 72 and the V-shaped member 21. The slide bar channel 73 is substantially transverse to and intersects the seat position channels 64, as explained in further detail below.

The seat position channels 64 preferably have a sideways "T" cross-section designed to accept, retain and guide a T-track 74, which is attached to each side of the bottom support 61, as shown. The seat T-track 74 includes a small v-notch 75 and may be entered into a desired channel 64 at the front end 76 of the chair side panel 70 and then guided to a terminal end 77 of the seat position channel 64 proximate the back end of the side panel 70. A taper on the leading end of the T-track 74 helps guide insertion into a desired seat position channel 64.

The seat position channels 64 extend such that the rearmost end of each channel 64 terminates progressively forward moving top to bottom of the panel 70. The result of this channel feature is that the bottom support 61 will move forward of the back support 62 as the bottom support 61 is lowered. This feature is directed to accommodating larger children as it intentionally moves the bottom support 61 forward to adjust to a longer upper leg with continued mid to upper back support.

Figure 14:
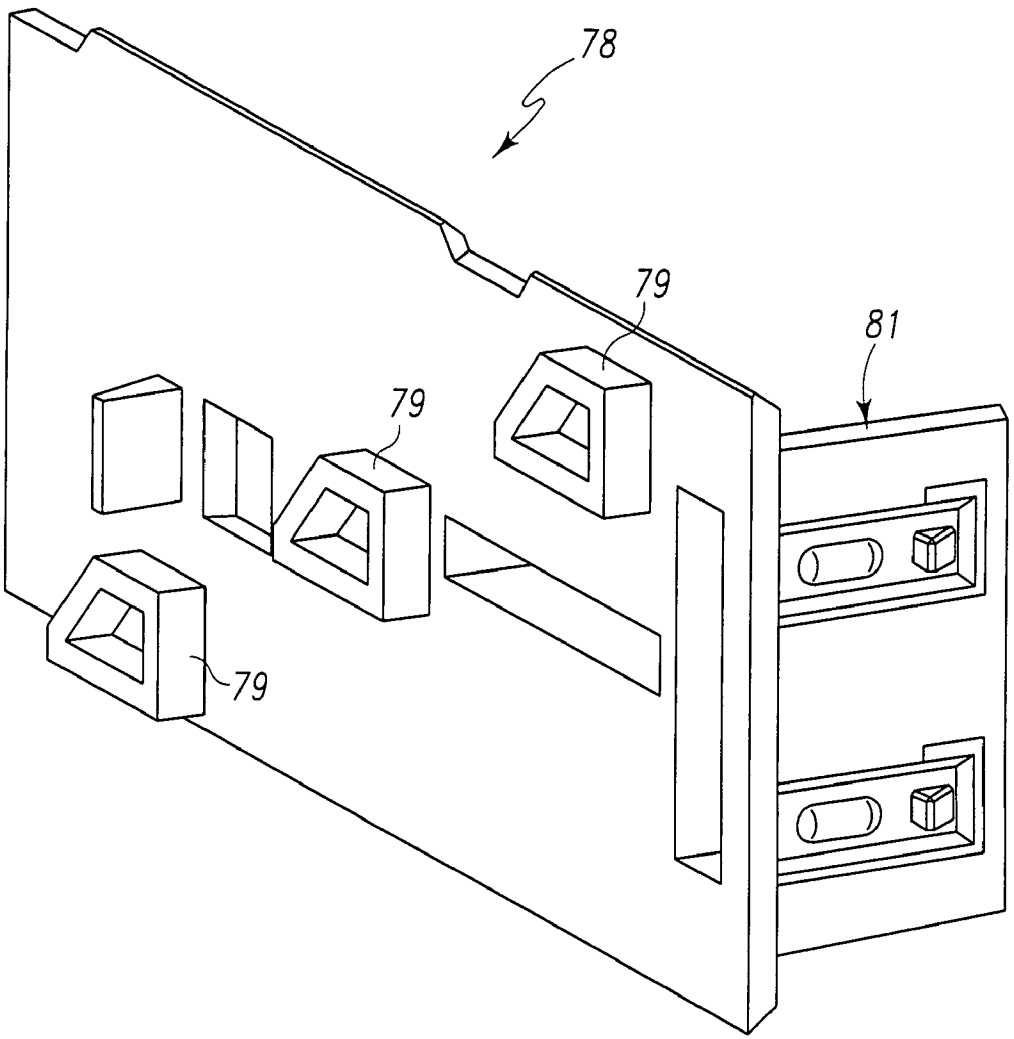
FIG. 14 is a perspective view of an embodiment of a slide bar of the present invention.
Figure 15:
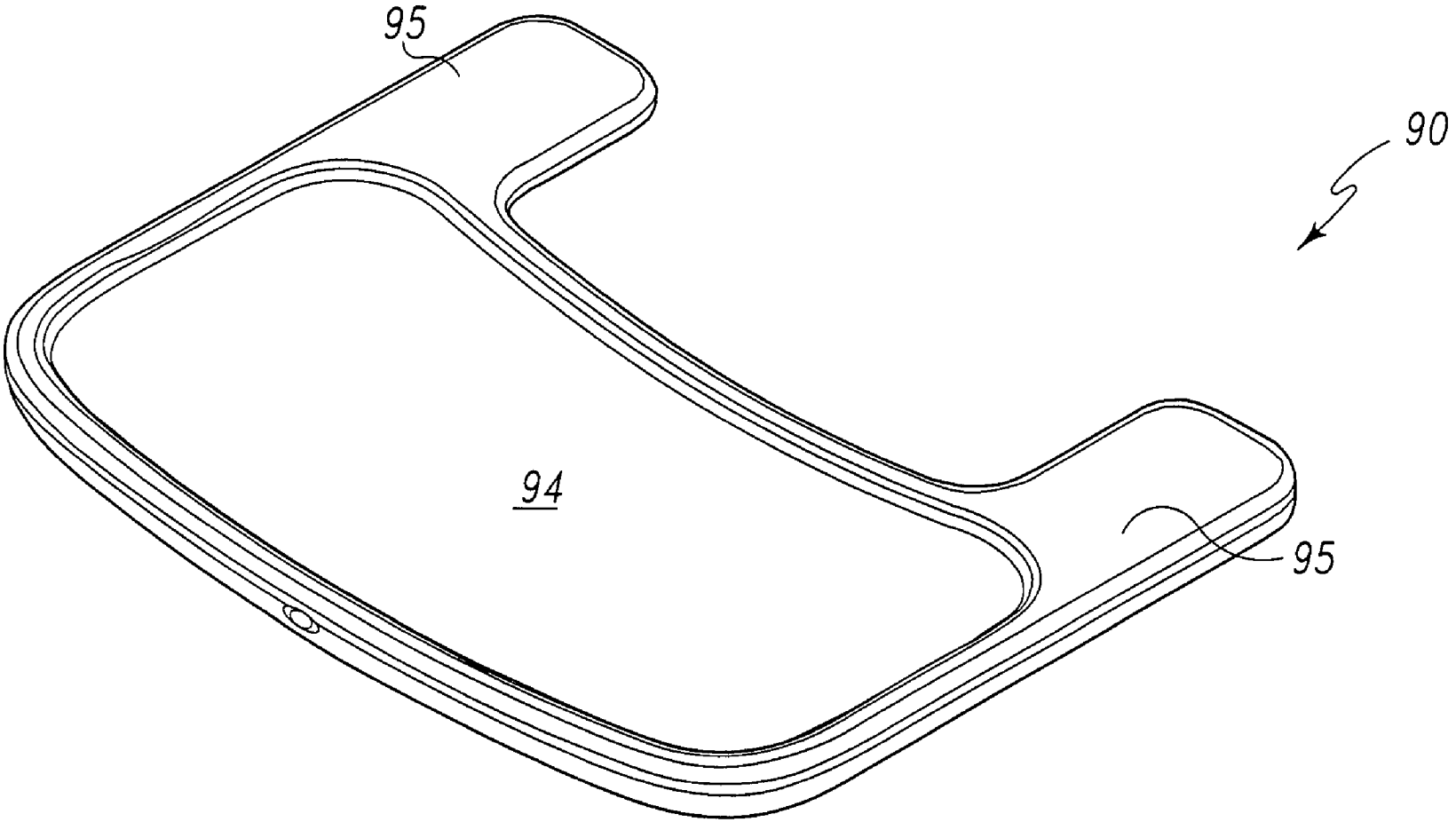
FIG. 15 is a perspective view of an embodiment of a tray of the present invention.
Figures 16A, 16B, 16C, 16D, 16E:
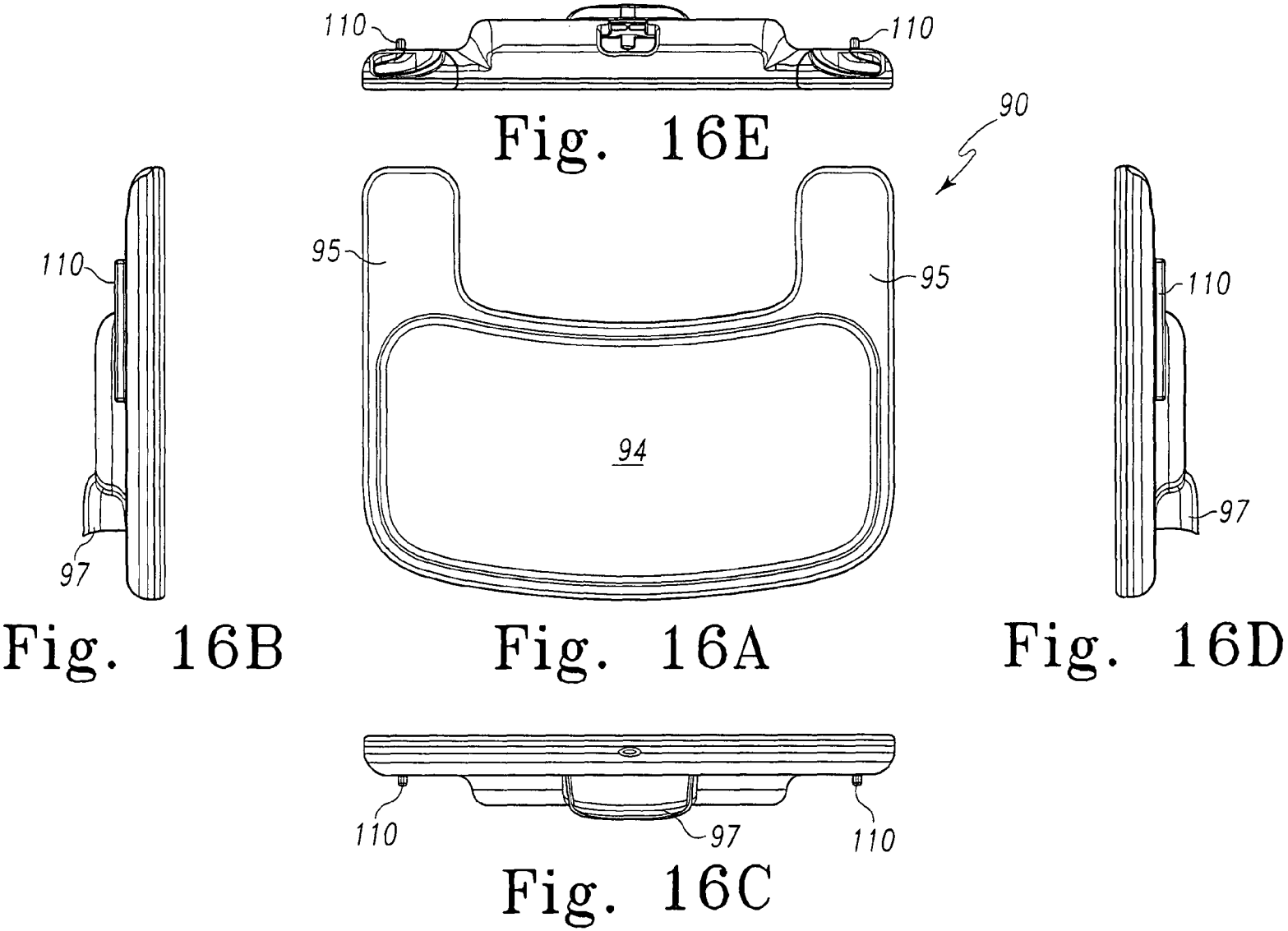
FIGS. 16A-16E are various views of an embodiment of the tray shown in FIG. 15.
Figure 17:
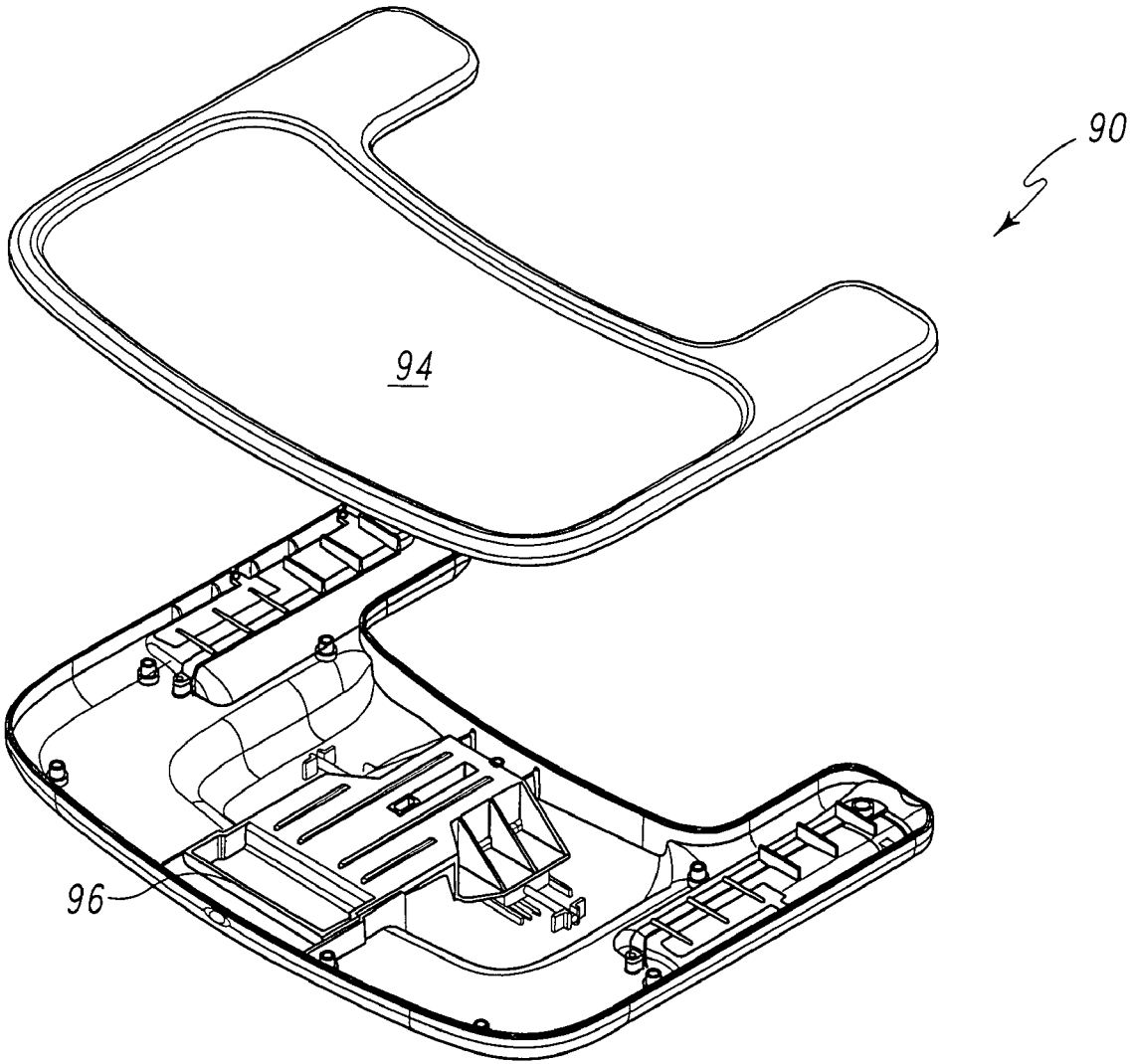
FIG. 17 is a partial exploded view of the tray of FIG. 15.
Figure 18A:
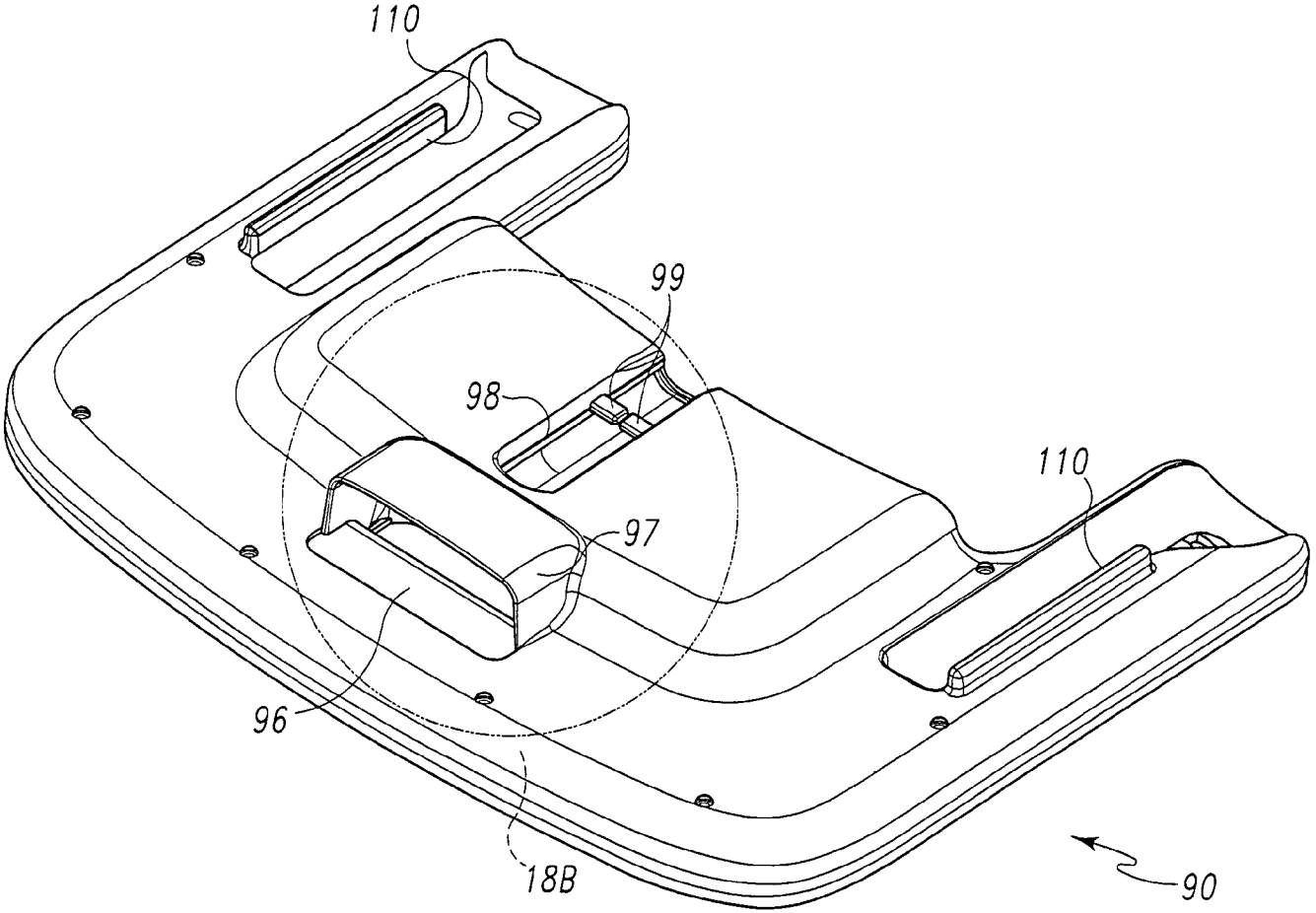
FIG. 18A is a perspective view of the underside of the tray of FIG. 15 in the "locked" position.
Figure 18B:
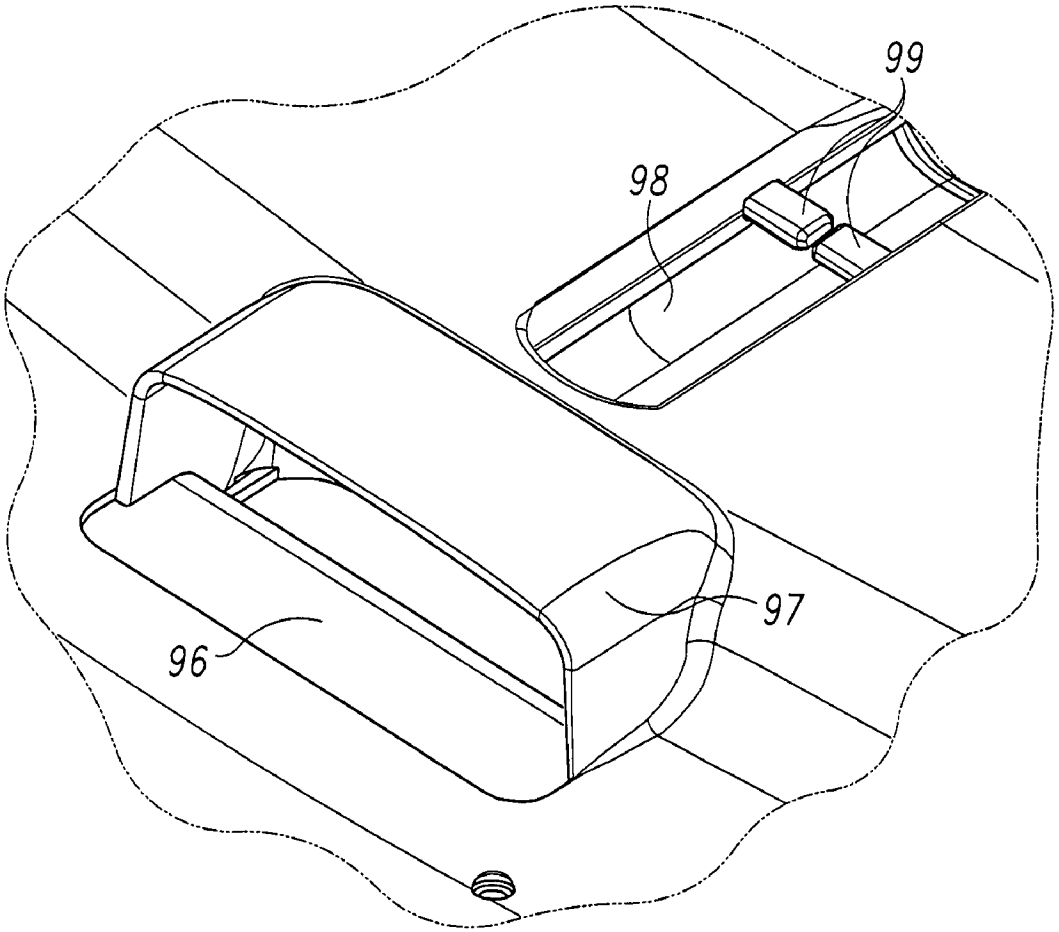
FIG. 18B is a close-up view showing detail of the area indicated in FIG. 18A.
Figure 19A:
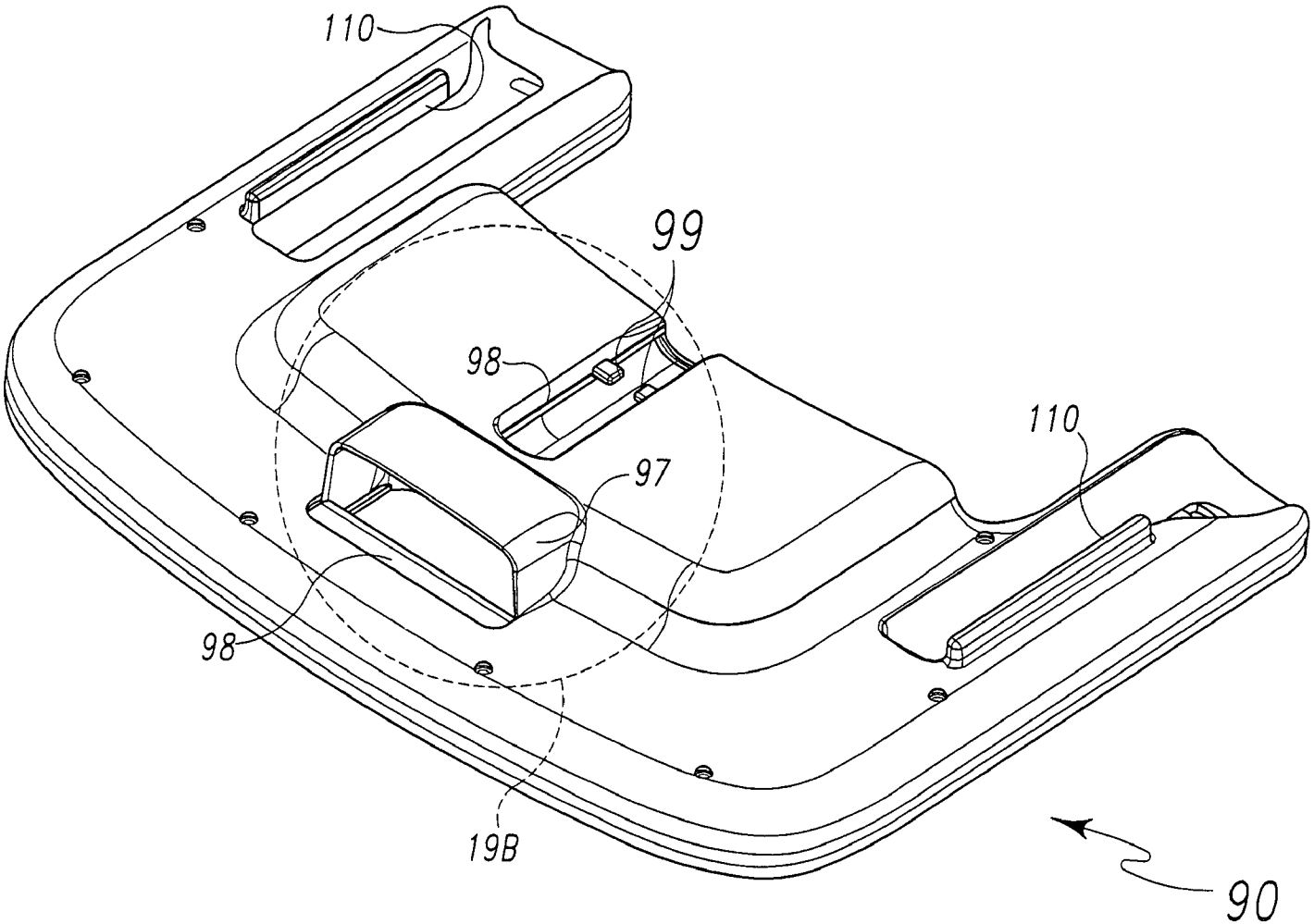
FIG. 19A is a perspective view of the underside of the tray of FIG. 15 in the "adjust" position.
Figure 19B:
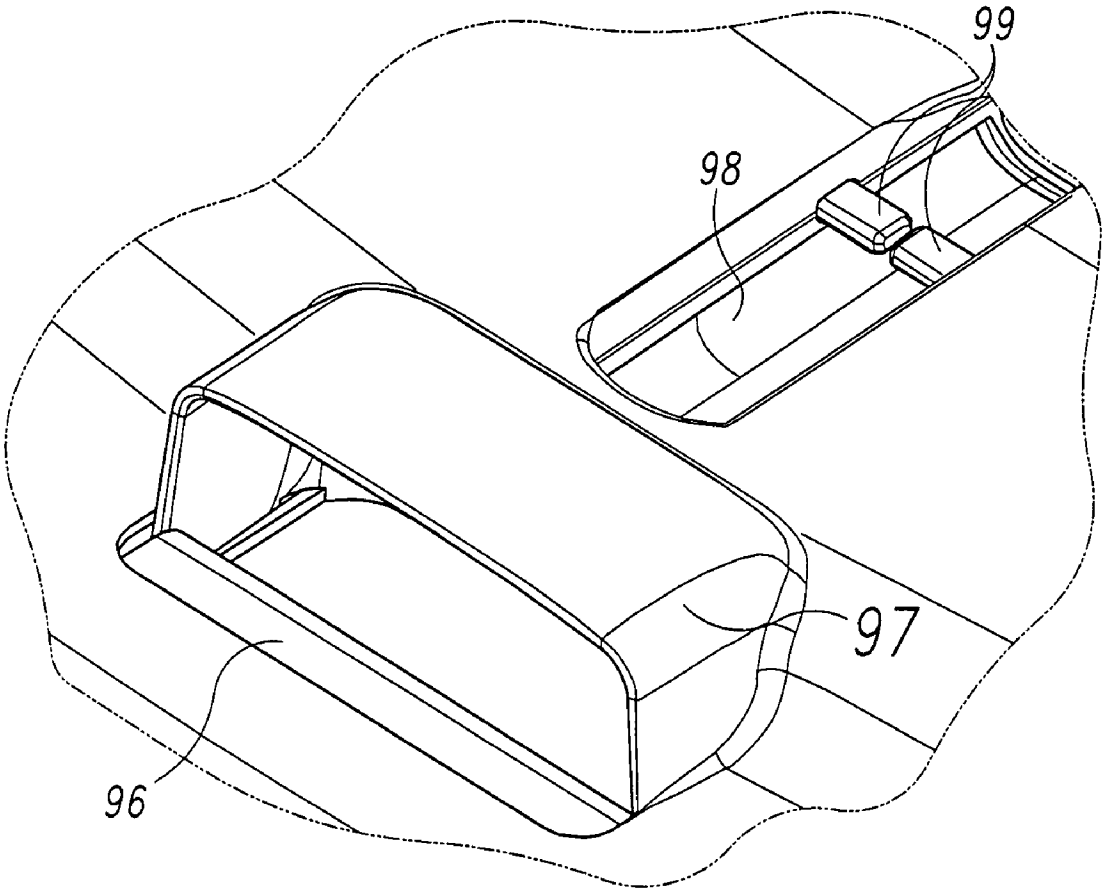
FIG. 19B is a close-up view showing detail of the area indicated in FIG. 19A.
Figure 20A:
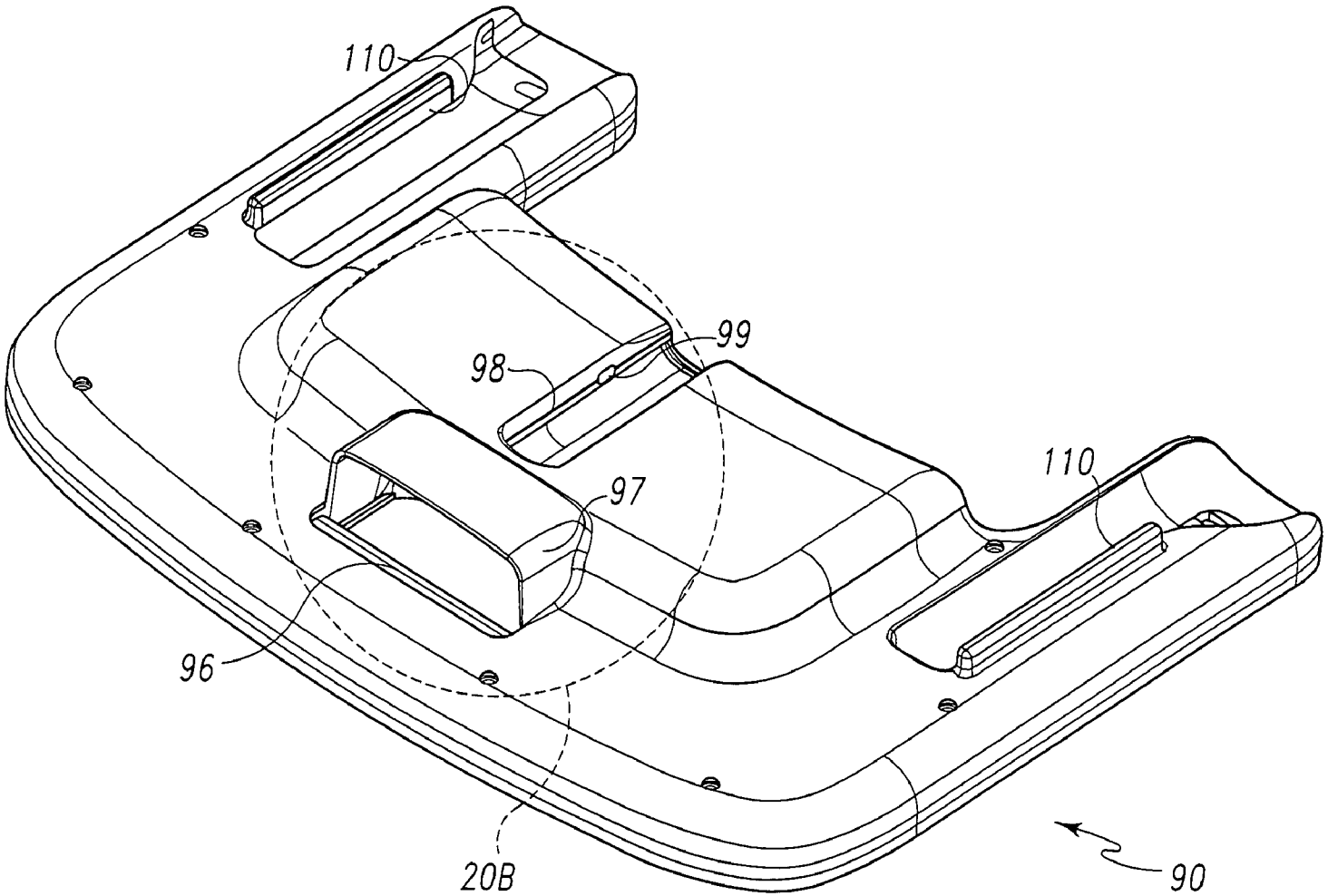
FIG. 20A is a perspective view of the underside of the tray of FIG. 15 in the "release" position.
Figure 20B:
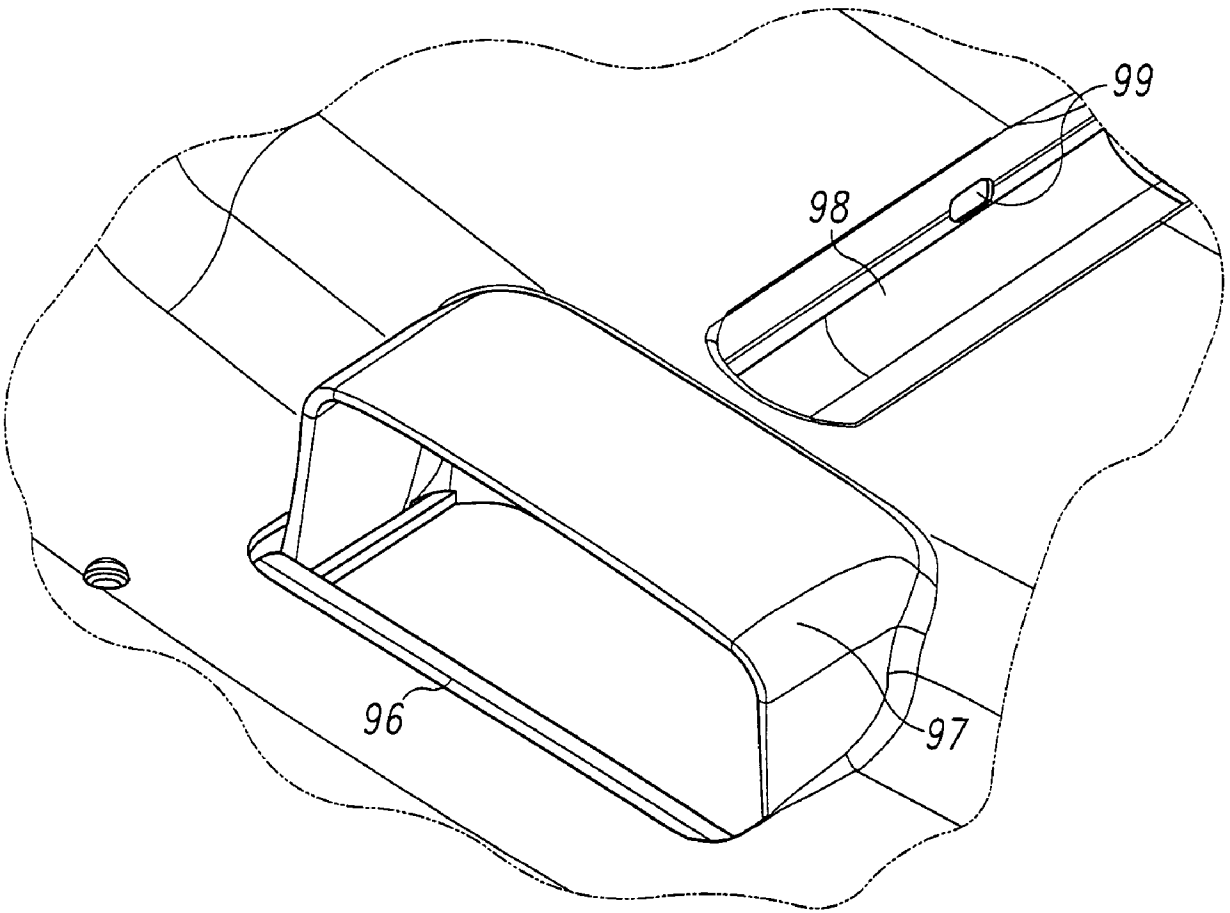
FIG. 20B is a close-up view showing detail of the area indicated in FIG. 20A.

To lock the bottom support 61 into one of the channels 64, a slide bar 78 operates within the slide bar channel 73 of at least one of the side panels 70. Preferably, the slide bar 78, as illustrated in FIG. 14, includes a flange 79 with a triangular end at each seat position channel 64 location—i.e., three flanges are used for three seat position channels. The corresponding flange 79 engages the v-notch 75 of the T-track 74 (FIG. 12) when the bottom support 61 is inserted into any of the seat position channels 64. The flange 79 prevents the T-track 74, and therefore the seat bottom support 61, from being withdrawn from the channel 64, locking the seat in place.

As shown in FIGS. 6A-E, the T-track 74 can be unlocked by moving the slide bar 78 (downward as shown) within the slide bar channel 73 to disengage the corresponding flange 79 from the v-notch 75.

Figure 7A:
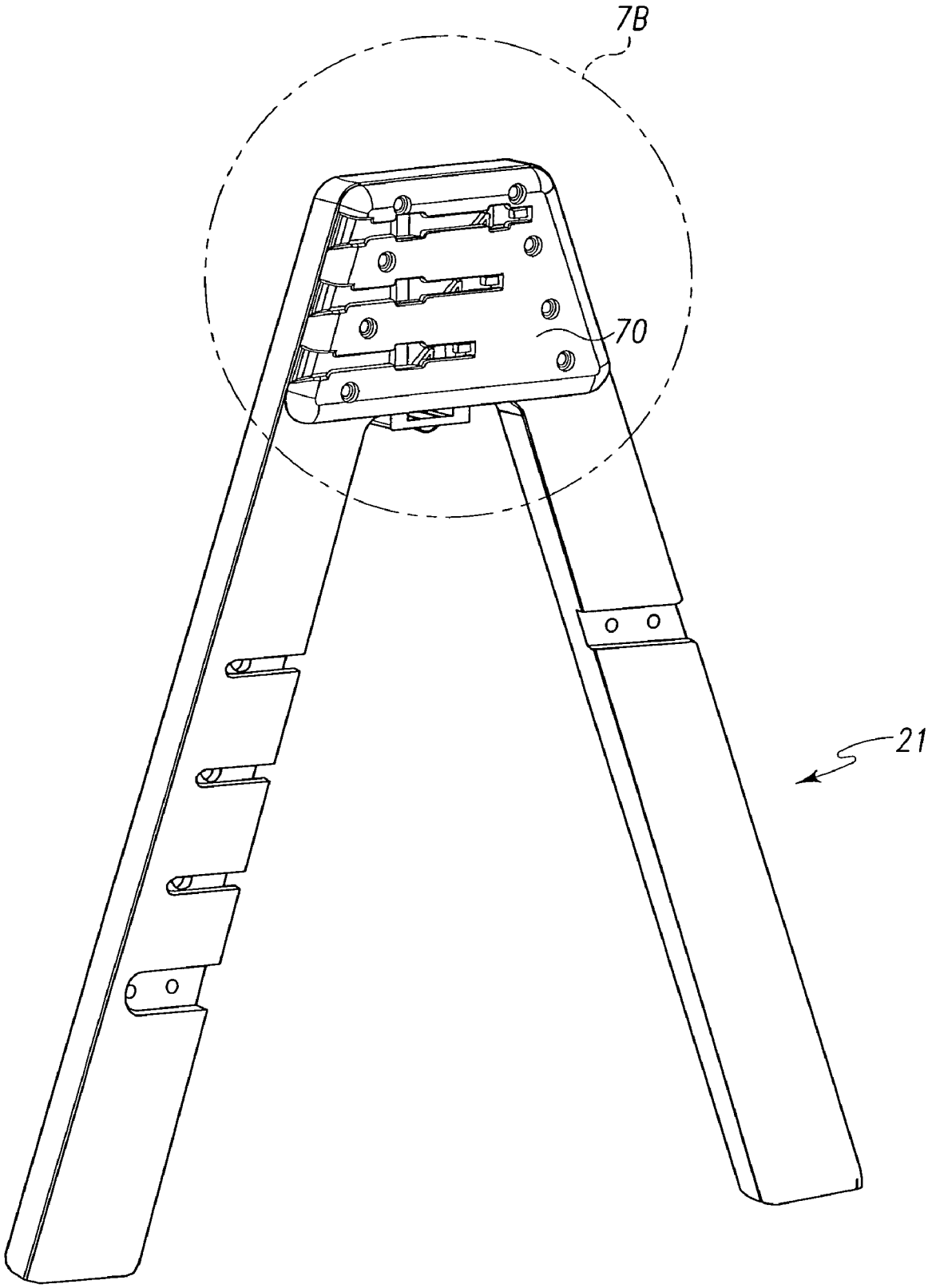
FIG. 7A is an inner side view of a V-shaped support member.
Figure 7B:
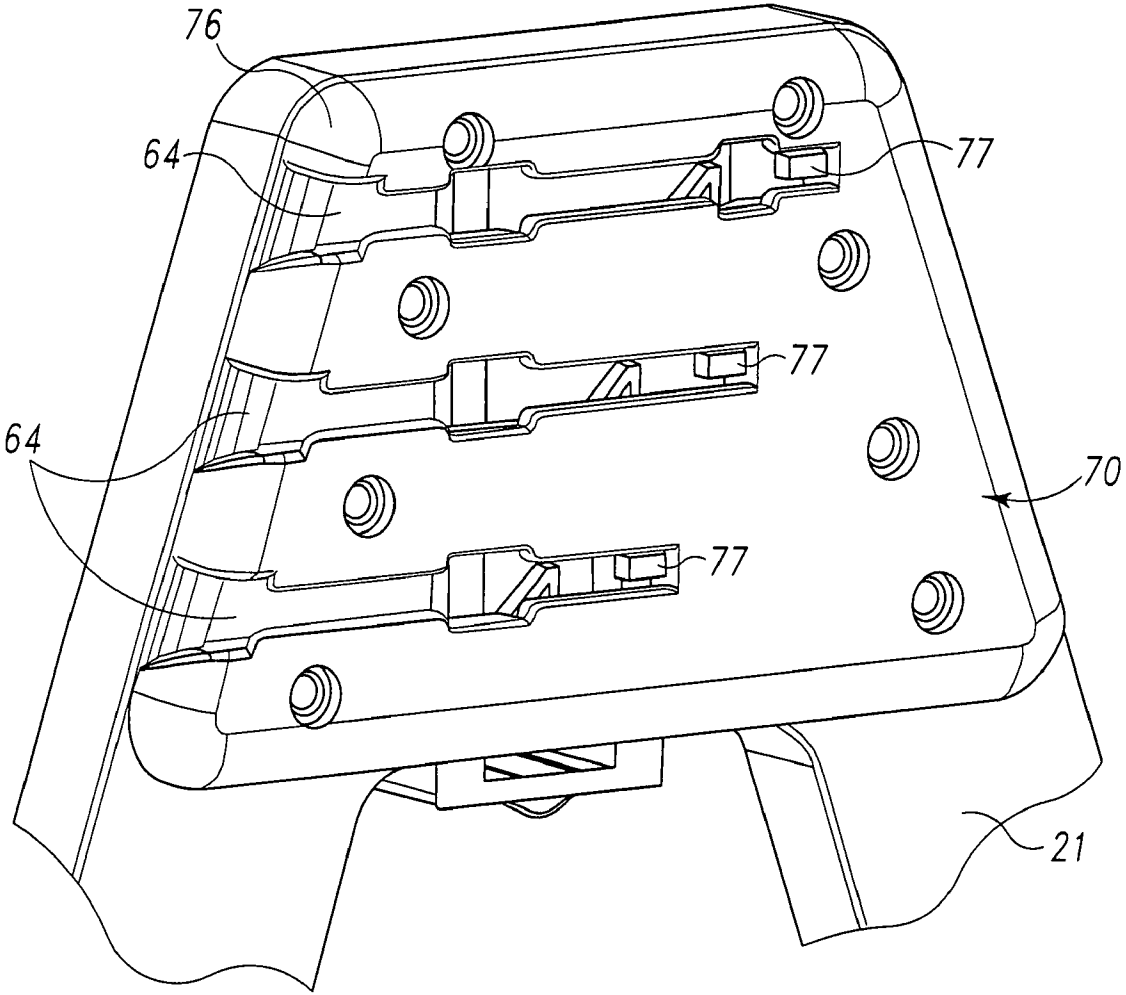
FIG. 7B is a close-up view showing detail of the chair side panel from FIG. 7A with the slide bar in a locked position.
Figure 8A:
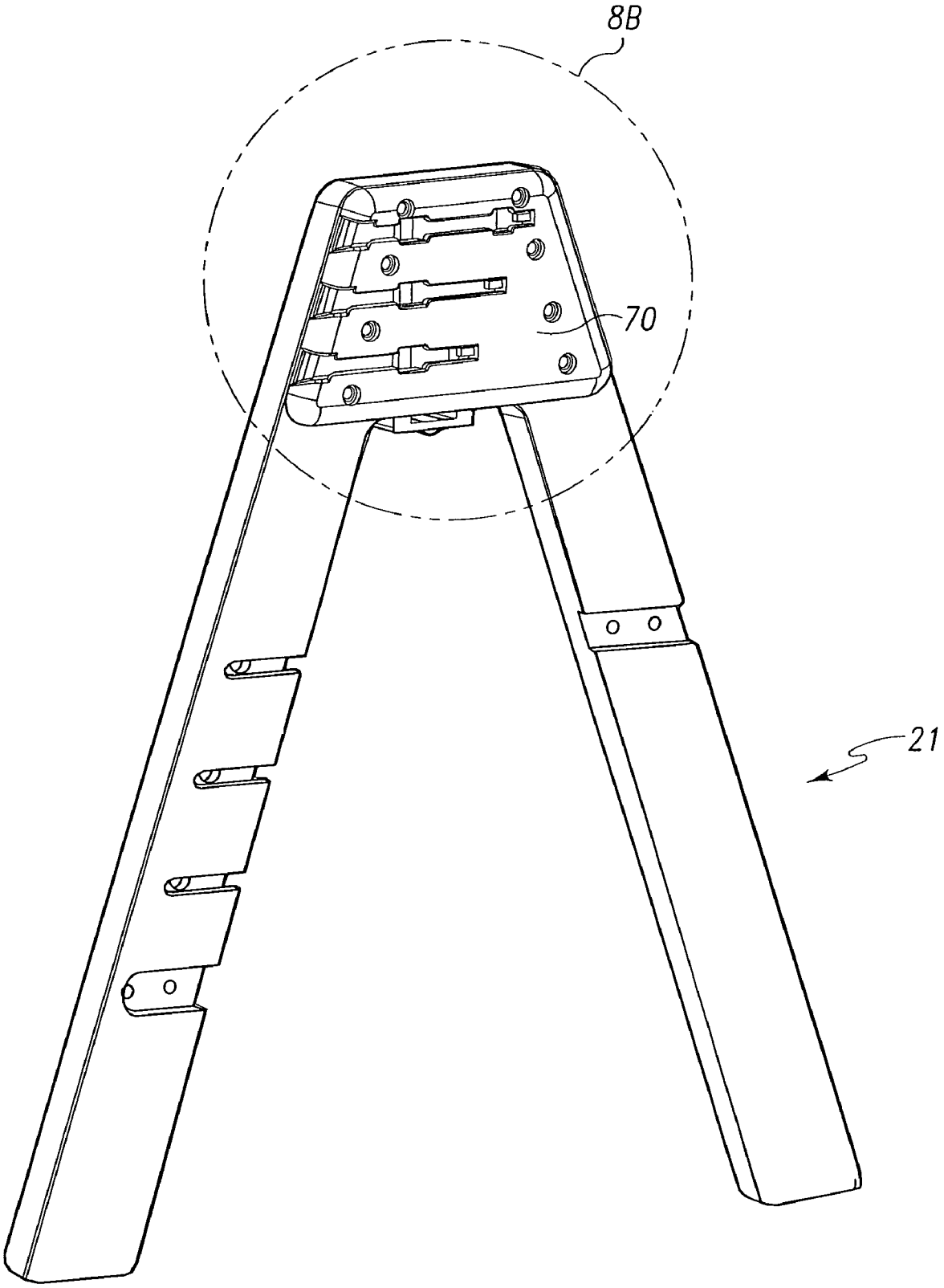
FIG. 8A is an inner side view of a V-shaped support member of FIG. 7A.
Figure 8B:
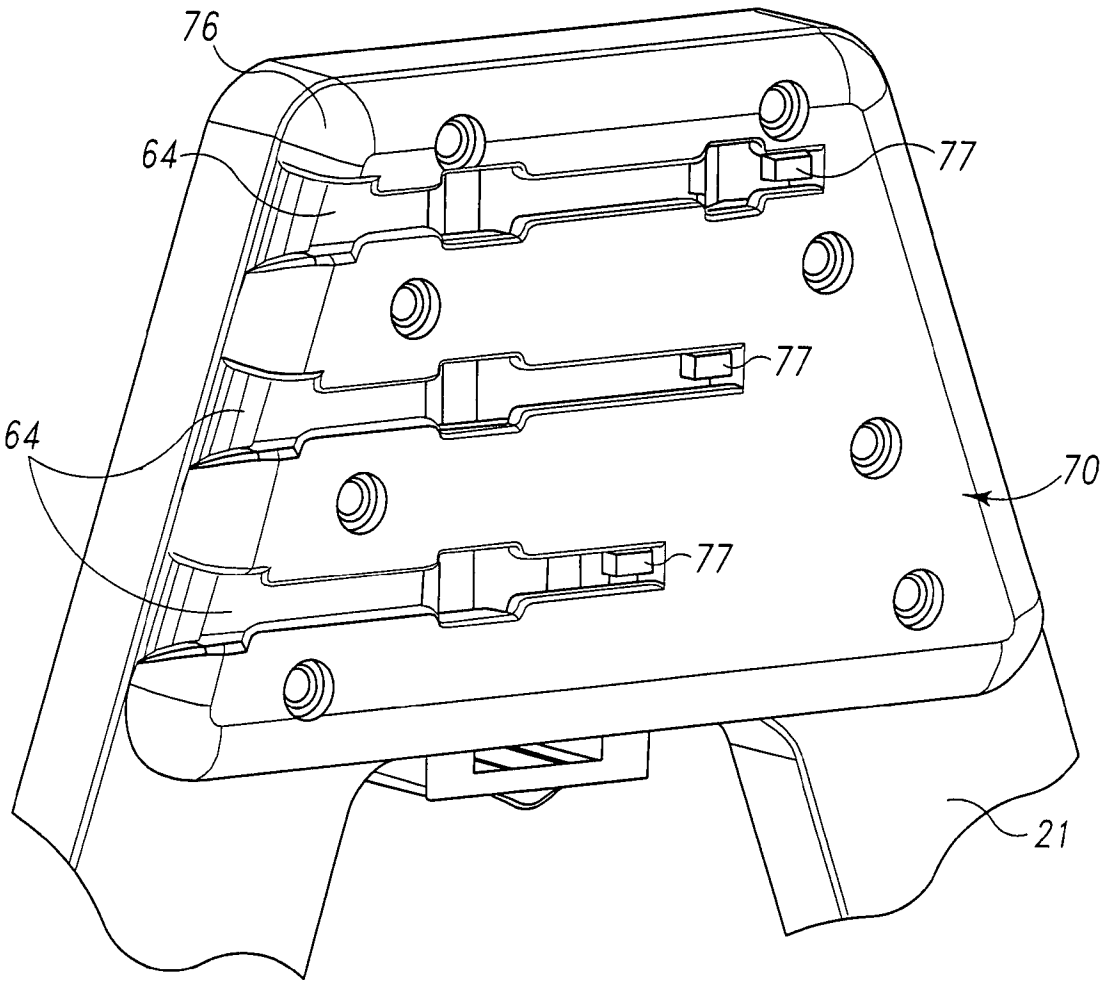
FIG. 8B is a close-up view showing detail of the chair side panel from FIG. 8A with the slide bar in an unlocked position.
Figure 9:
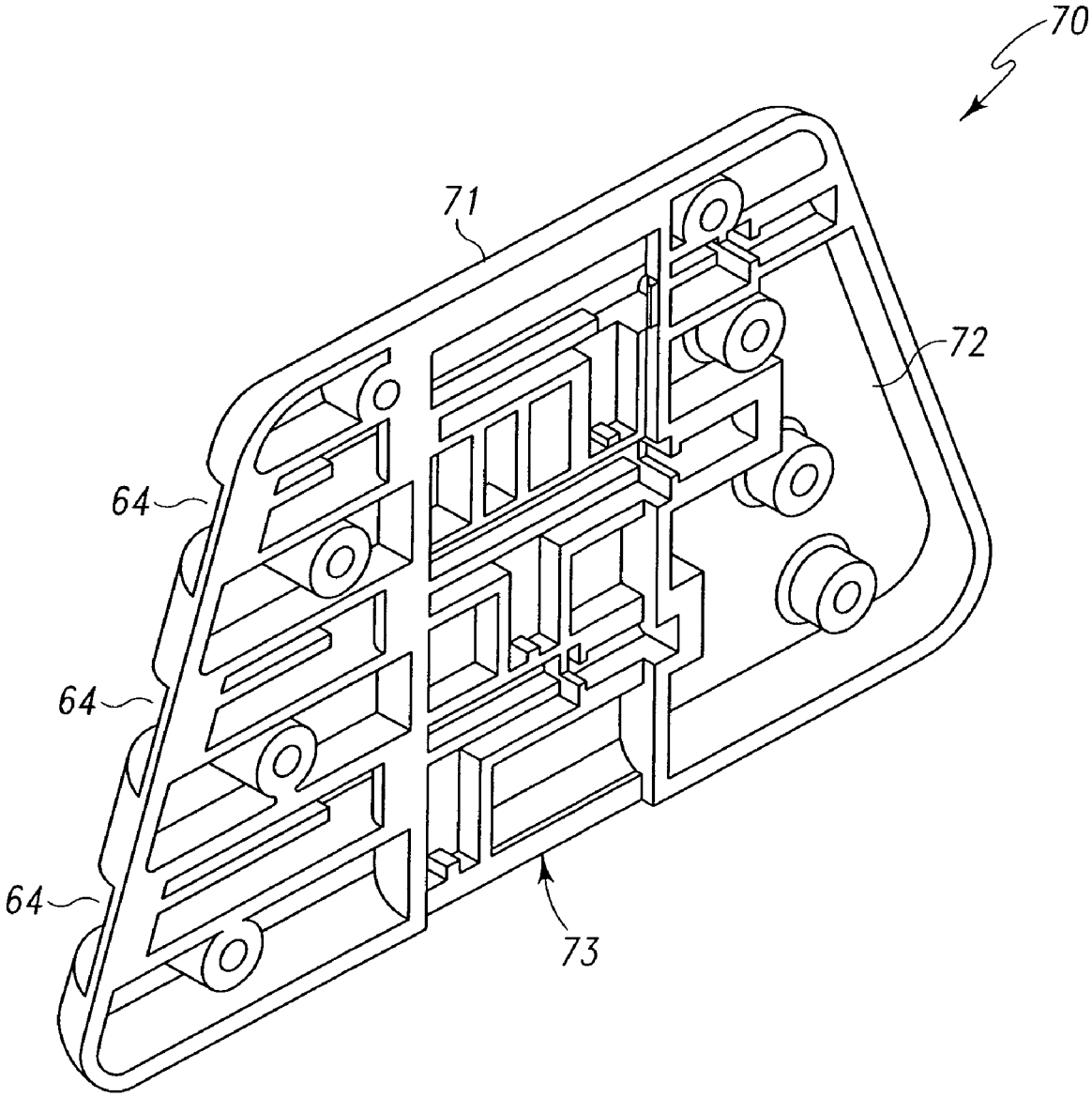
FIG. 9 is a perspective view of a second (or inner) side of a chair side panel.

Referring to FIGS. 7-8, operation of a release button 80 is illustrated. The release button 80 slidably attaches to a ledge 81 extending from an end of the slide bar 78. The release button 80 locks and unlocks the slide bar 78 from vertical movement. The release button 80 may include a small protuberance or other such positive tactile effect on a bottom surface which facilitates gripping and movement of the release button 80 between the locked and unlocked positions by a user's finger.

Figure 6C:
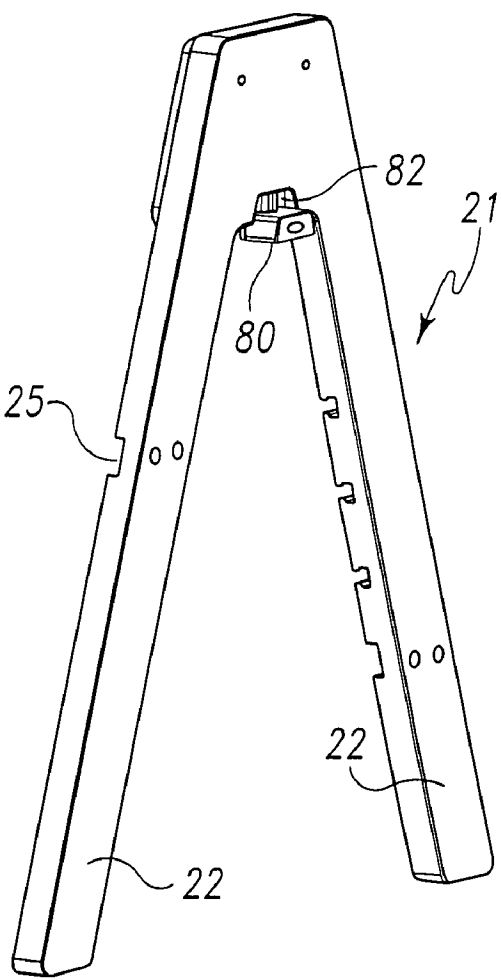
FIGS. 6A-6C are outer side views of an embodiment of a V-shaped support member illustrating the operation of a release button.
Figure 6B:
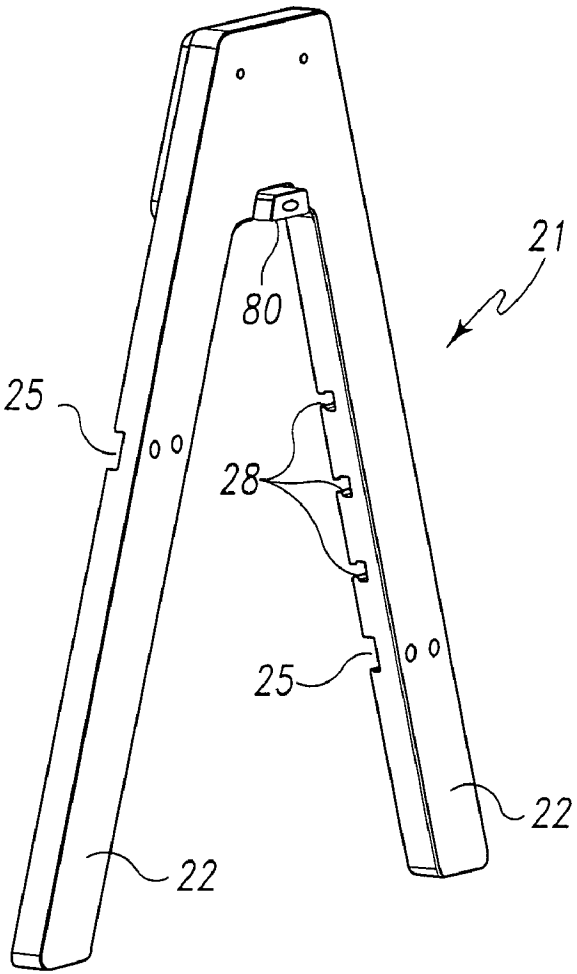
Figure 6A:
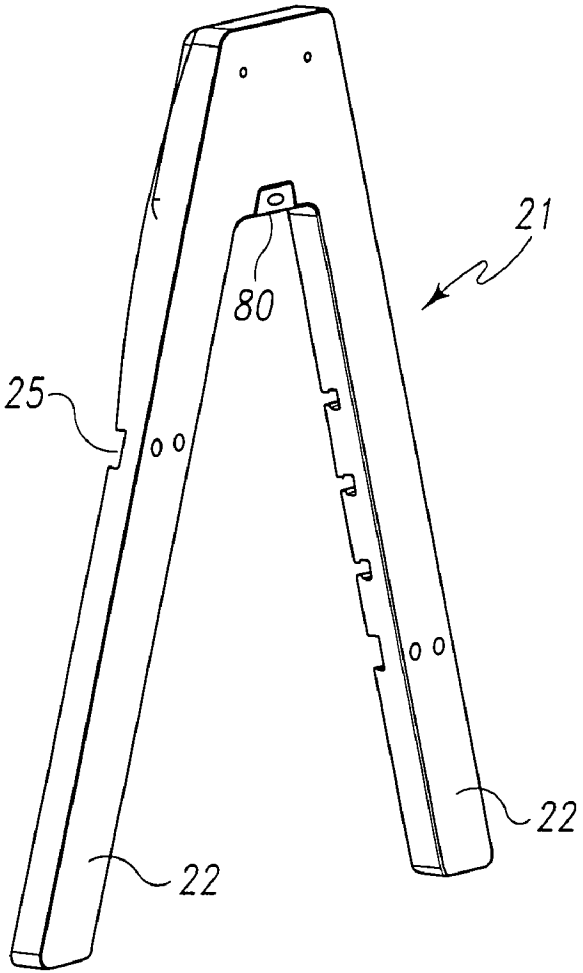

Referring back to FIGS. 6A-6E, the release button 80 is preferably flush with both the underside and the outer surface of the frame 20 when in a locked position. A small notch 82 in the frame member 21 accommodates the release button 80 so that it may be not only flush to the frame 20, but also inconspicuous to little children who might otherwise pull and push on such a device. When unlocked, as shown in FIGS. 6B and 6C, the release button 80 extends outward of the frame surface which allows the slide bar 78 to be adjusted vertically for locking and unlocking the bottom support 61 in the seat position channels 64, as described above.

Center Post

Figure 11:
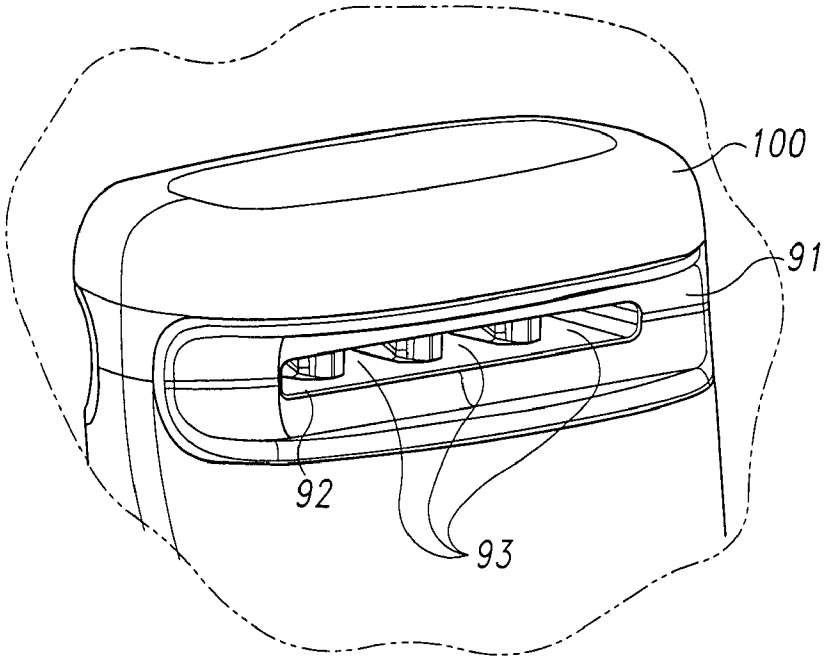
FIG. 11 is a close-up view showing detail of the center post of FIG. 10.
Figure 13:
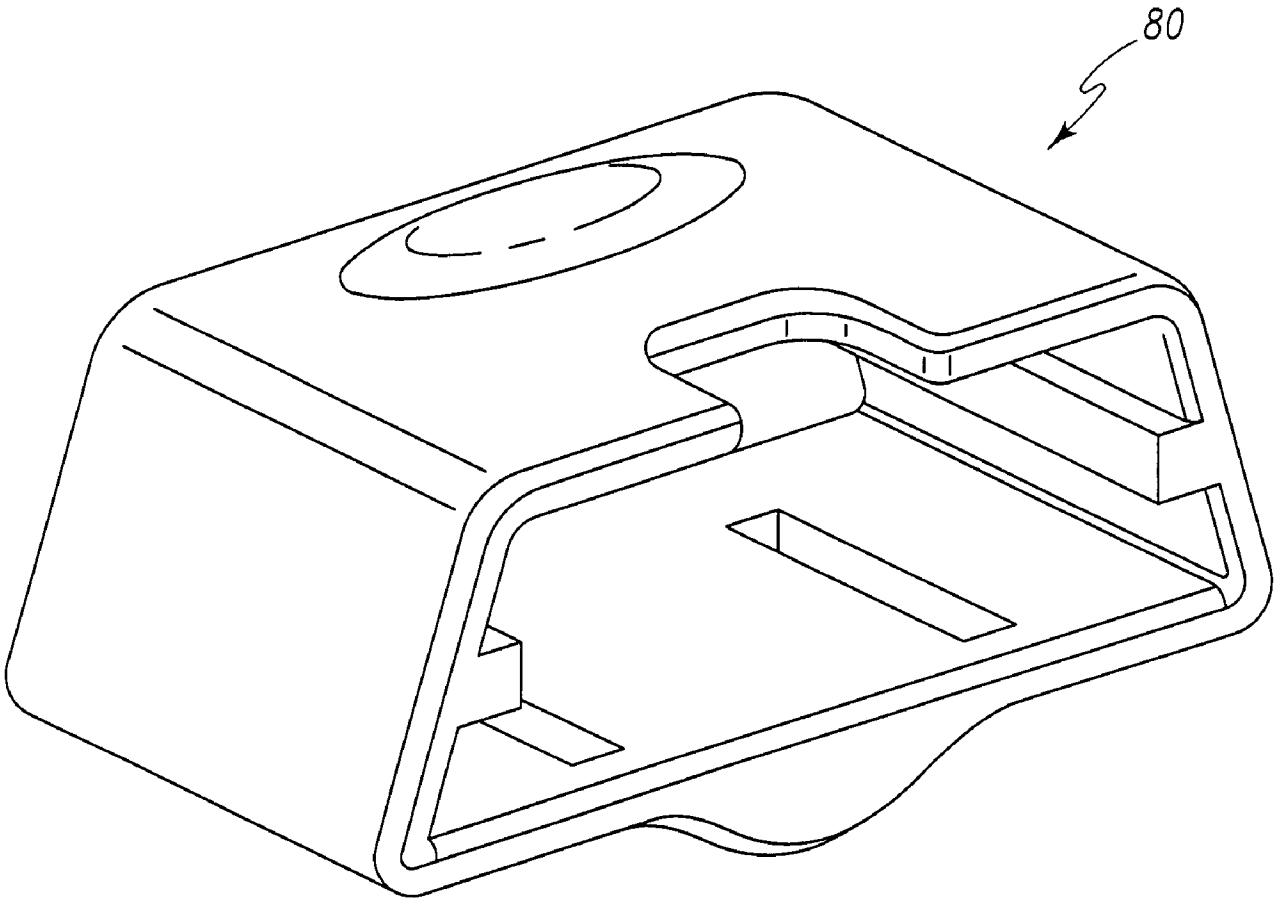
FIG. 13 is a perspective view of an embodiment of the backside of a release button of the present invention.

Referring to FIGS. 10 and 11, detachably mounted on a top surface of the bottom support 61 is the center (or crotch) post 100. The post 100 is intended to provide a number of benefits for the disclosed highchair. Preferably, the post 100 is attached via suitable screws or bolts advanced from the underside of the bottom support 61. However, most any manner of attachment which results in a sturdy center post 100 would be suitable.

A first benefit of the center post 100 is that of a safety device, holding a child seated in the chair 10 from slipping forward off of the bottom support 61. The post 100 is preferably centered across the bottom support 61 to allow a child to straddle the post 100 when seated. The center post 100, however, is not intended to be the exclusive support for children and should be used in conjunction with other safety measures.

The center post 100 also provides a single harness attachment point 102. The harness attachment point 102 is created using a harness strap 104 which extends from a slot 106 in the base of the center post 100. The resulting harness 120, of course, is another safety feature which is used in many child seats. A suitable harness buckle 122, depending on the type of safety harness used—e.g., a two-point harness or a three-point harness—is attached to the extending end of the strap (i.e., the free end outside of the post). Removing the center post 100 may render the remaining harness straps unusable.

Still another feature of the center post 100 is that it provides exclusive attachment for the tray 90. Referring to FIG. 11, at the upper end of the center post 100 a tray guide 91 is shown. The tray guide 91 is open at both ends to allow a tray 90 (see discussion below) to be attached from either direction. However, the guide 91 may be open at only the forward face of the center post and closed at the rearward face, if desired. Within the tray guide 91 a retention channel 92 is shown which includes a plurality of tray position notches 93. The tray guide 91 allows a tray to move laterally without being detached from the center post 100. The position notches 93 permit a tray to be fixed to a specific position. A preferred embodiment shown has three (3) distinct position notches 93 to provide three separate tray attachment depths. Obviously, more adjustability may be provided with more position notches, if desired.

Tray

Referring to FIGS. 15-20, a preferred embodiment of the highchair tray 90 can be seen. From the top, the tray 90 is shown to include a recessed food area 94 and two arm rests 95. A bottom view of the tray 90 shows a single handle 96 positioned toward a forward edge of the tray. A small hand shroud 97 covers the handle 96. Rearward of the handle 96 and shroud 97 is located a center post channel 98 including pins 99. From the internal view of the tray 90 it can be seen that the handle 96 is directly linked to the pins 99 such that movement of the handle 96 results in movement of the pins 99.

The handle 96 is capable of moving between three positions: locked, adjust, and release. In the "locked" position, shown in FIGS. 18A and 18B, the handle 96 is mostly exposed within the shroud 97 and the pins 99 are completely extended within the center post channel 98. In the "adjust" position, shown in FIGS. 19A and 19B, the handle 96 is positioned approximately halfway in the shroud 97 and the pins 99 are approximately half extended into the center post channel 98. Finally, in the "release" position, shown in FIGS. 20A and 20B, the handle 96 is nearly completely out of the shroud 97 and the pins 99 are retracted completely.

Referring back to the center post 100 drawings and description, the tray 90 is positioned on the center post 100 by aligning with the center post channel 98. With the handle 96 in the "release" position, the tray 90 can be properly placed into contact with the top of the post 100. Then, as the handle 96 is allowed to move, via, for example, a spring bias (not shown), to the "adjust" position, the tray 90 is secured to the post 100 by the pins 99 simultaneously moving to enter the retention channel 92. Further release of the handle 96 by the user moves the pins 99 to the "locked" position. In this position, the pins 99 enter one of the tray position notches 93, preventing the tray 90 from further movement in the guide 91. To move the tray 90 to a new position notch 93 the handle 96 need only be moved to the "adjust" position, where the pins 99 will be locked into the retention channel 92 but not within a particular position notch 93. When the pins 99 are locked in the retention channel 92, the tray 90 can only be moved laterally but cannot be removed from the center post 100. This is all achieved, of course, with the use of a single hand by the user.

In order to help guide the tray 90, two additional guides 110 can be formed on the underside of the tray 90, as shown. These additional guides 110 mate with the upper portions of the bottom support 61. The guides 110 help prevent the tray from being twisted on the post 100 which might cause damage to the tray locking feature described, including the pins 99, and decrease effectiveness.

Harness

For clarity of other drawing figures, the harness 120 is not illustrated in most views. However, it is understood that such embodiments could include the use of a harness as described below.

Figure 21:
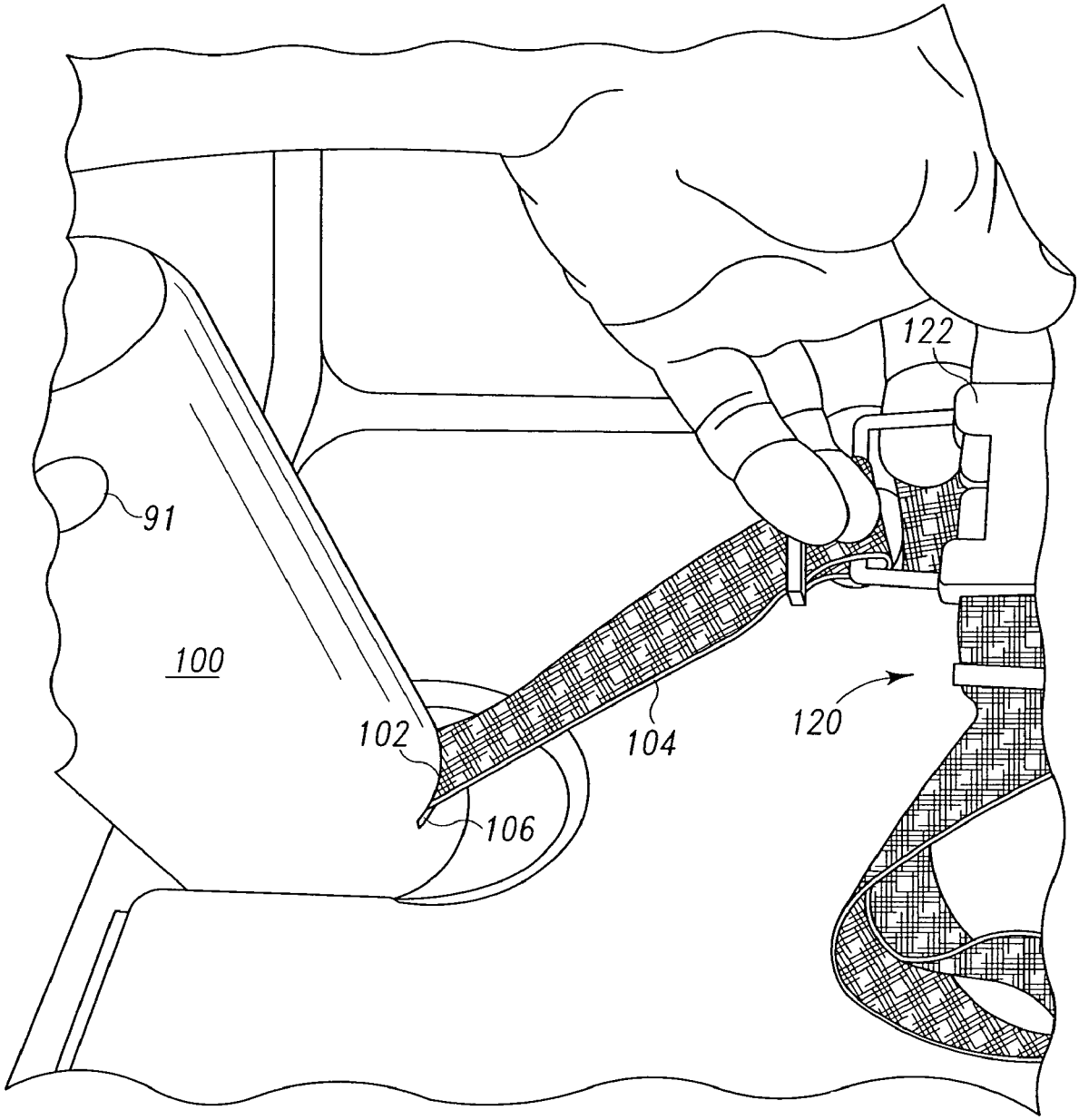
FIG. 21 is a perspective view of an embodiment of the harness system showing the attachment point at the base of the center post.
Figure 22:
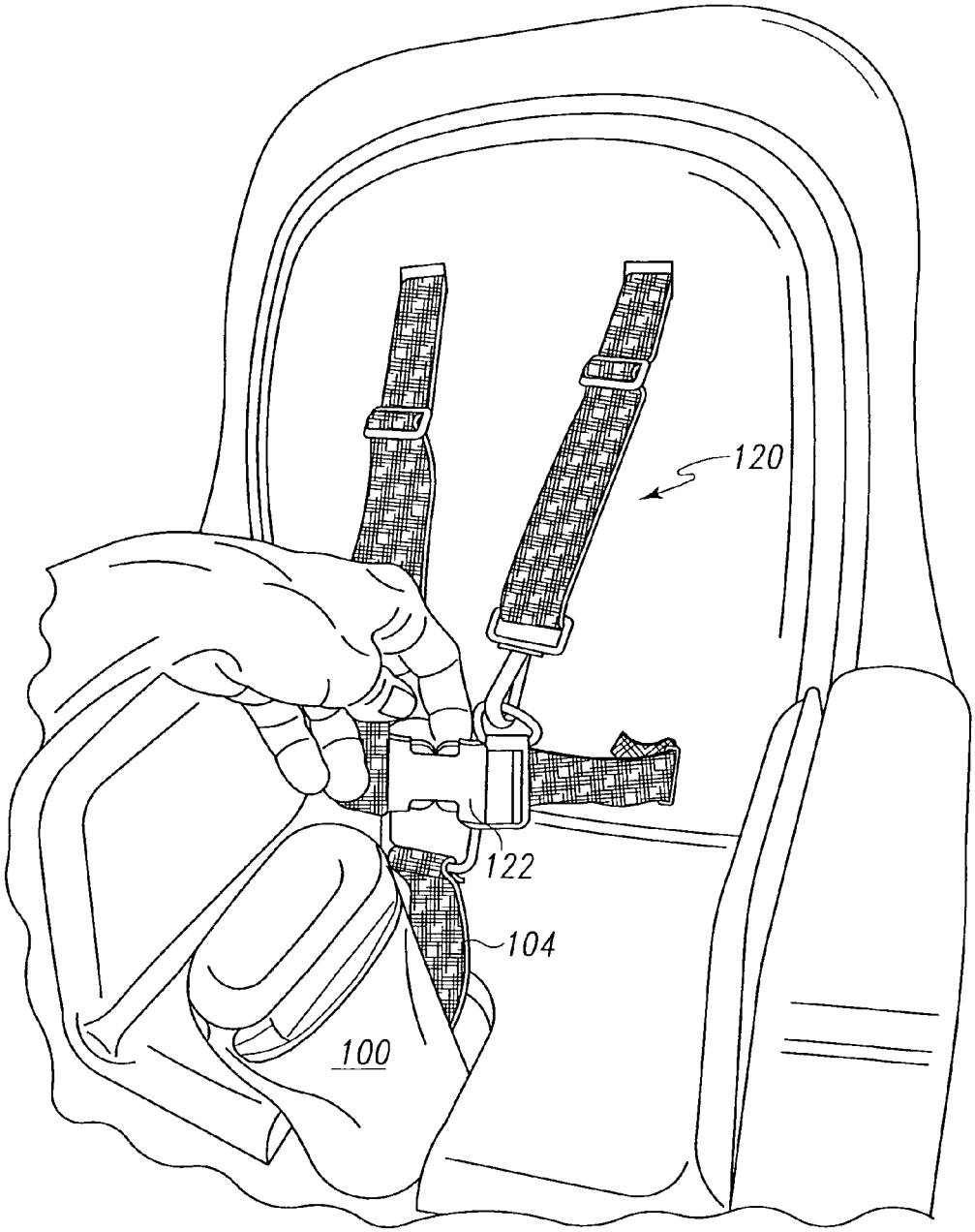
FIG. 22 is a perspective view of a five-point harness system used in an embodiment of the present invention.
Figure 23:
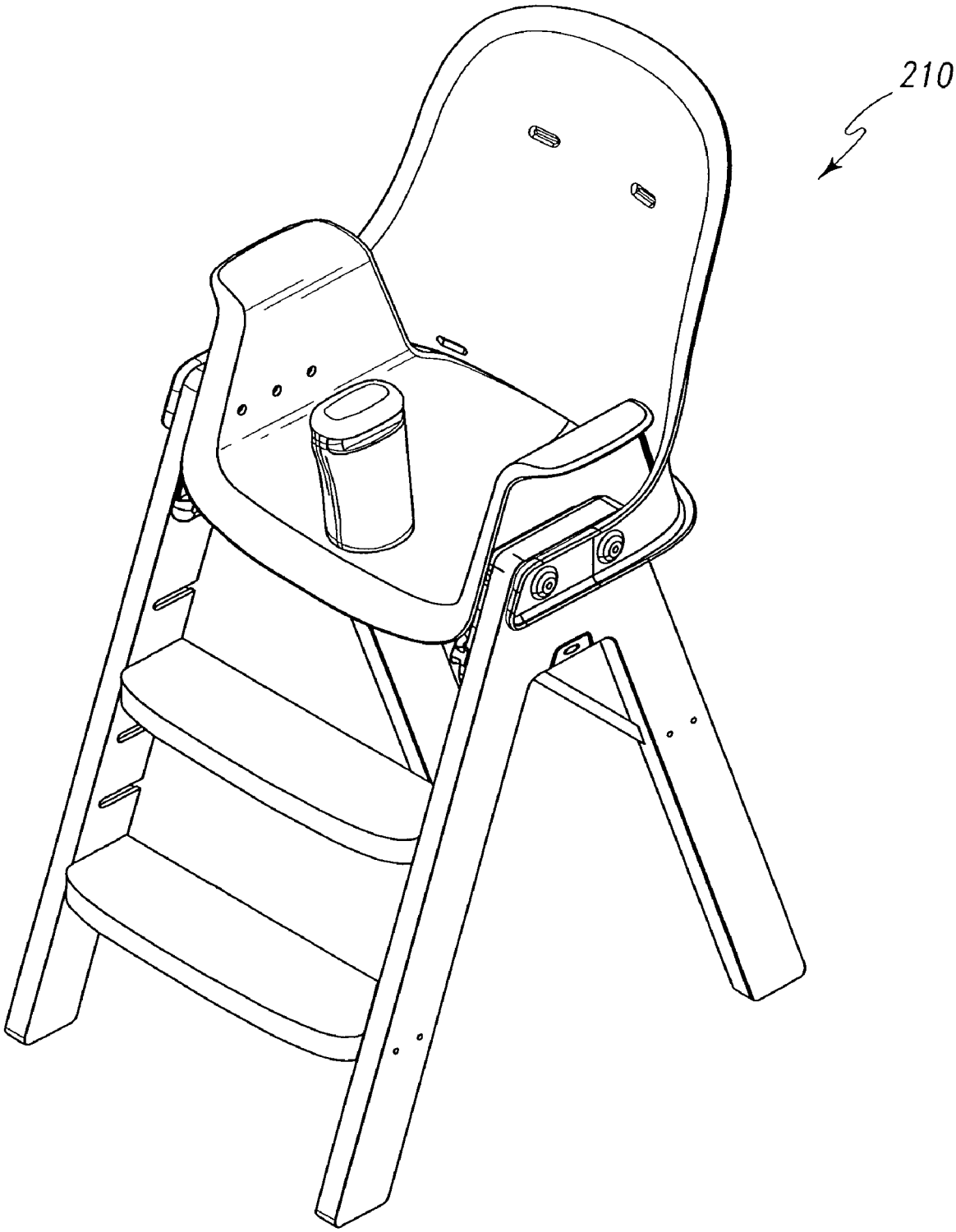
FIGS. 23-26 are various views of another embodiment of the highchair of the present invention.
Figure 24:
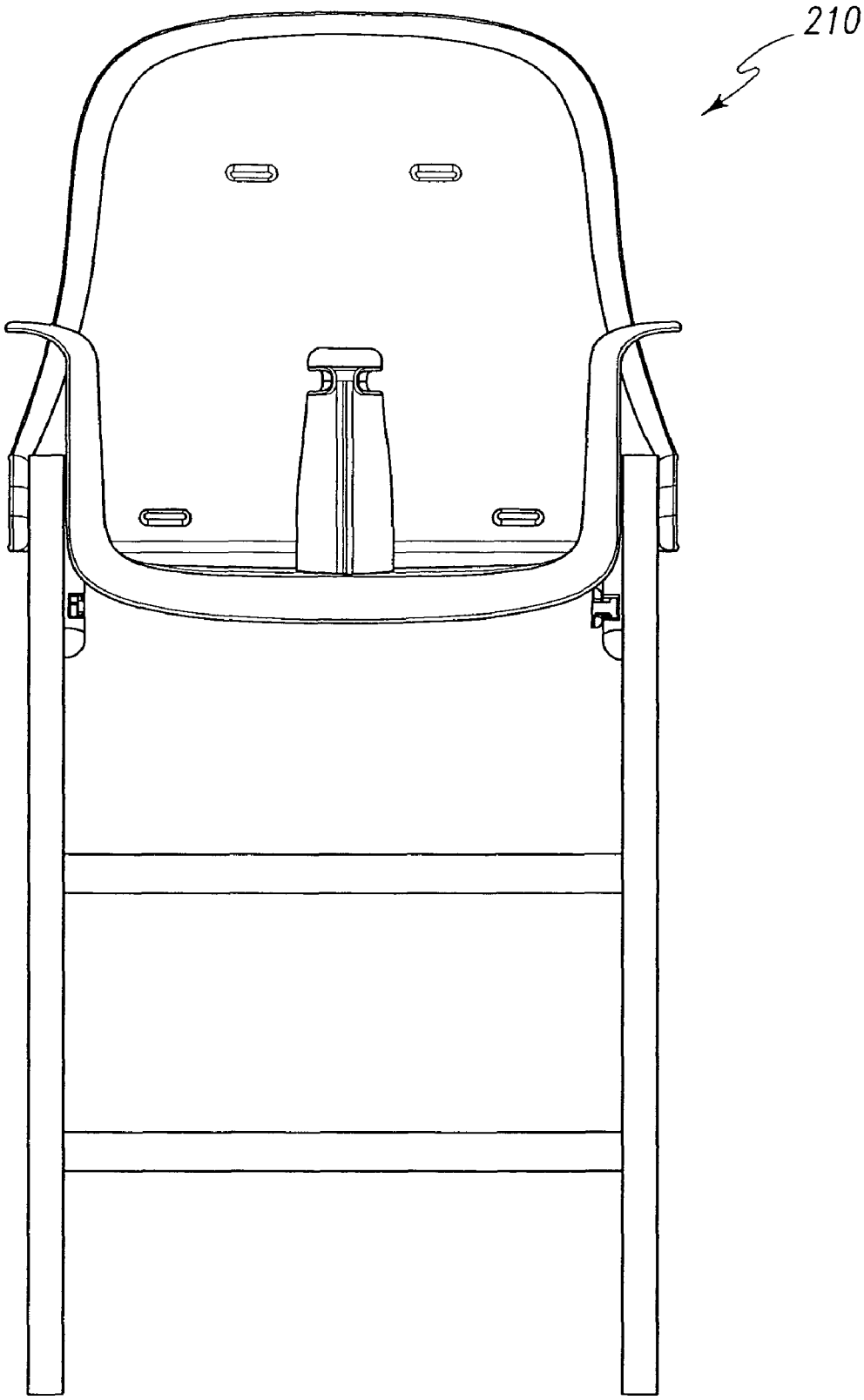
Figure 25:
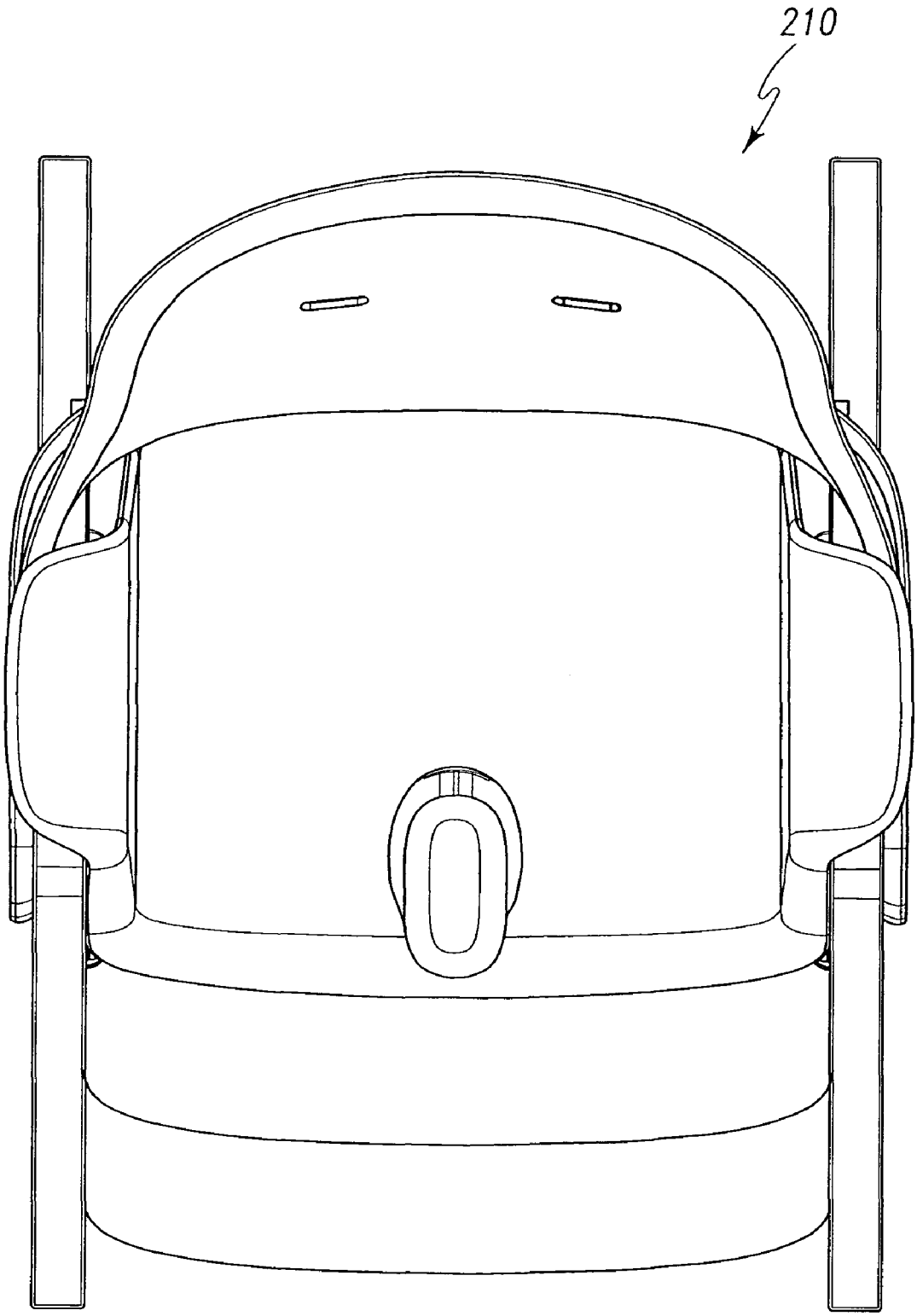
Figure 26:
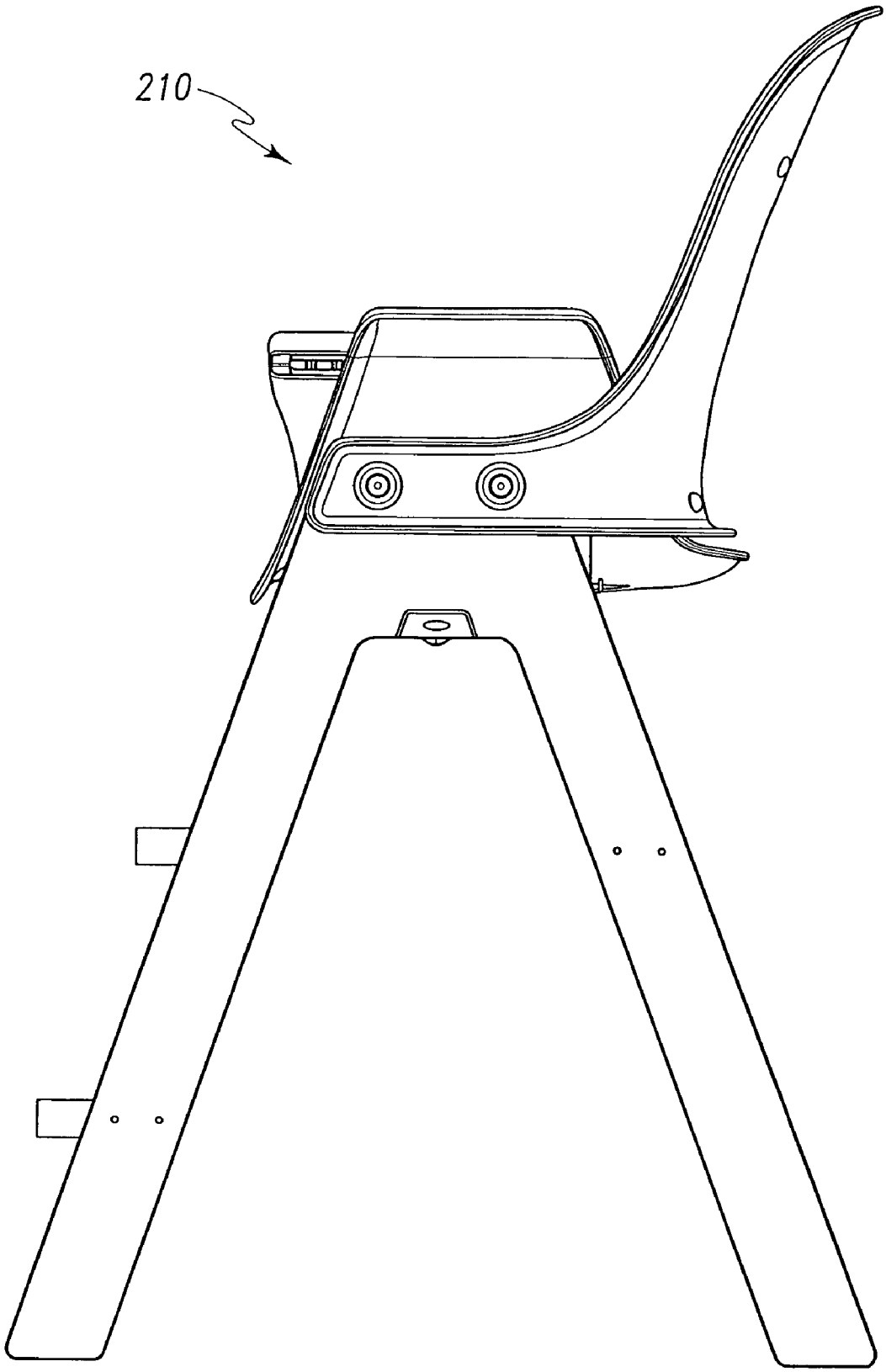
Figure 27:
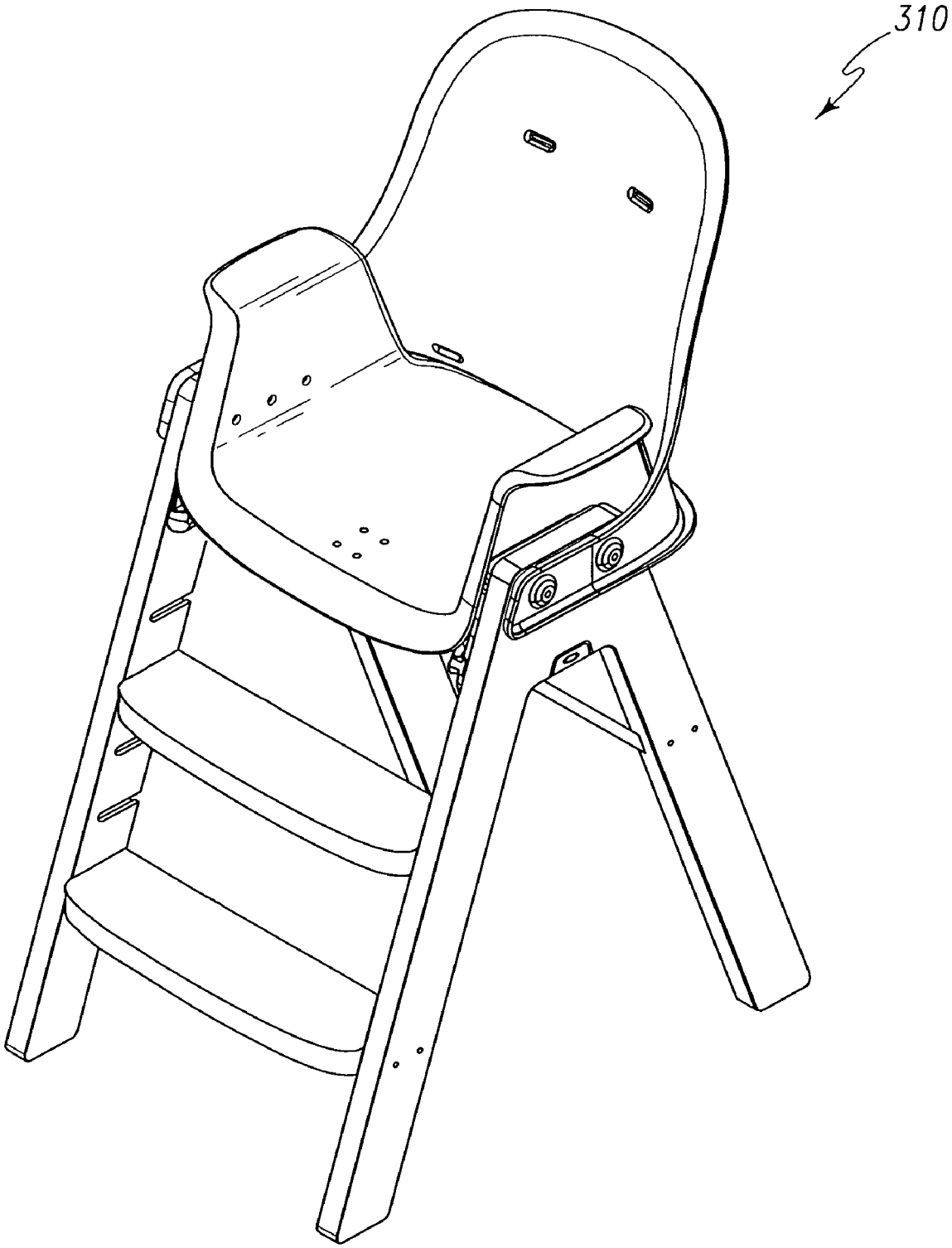
FIGS. 27-30 are various views of another embodiment of the highchair of the present invention.
Figure 28:
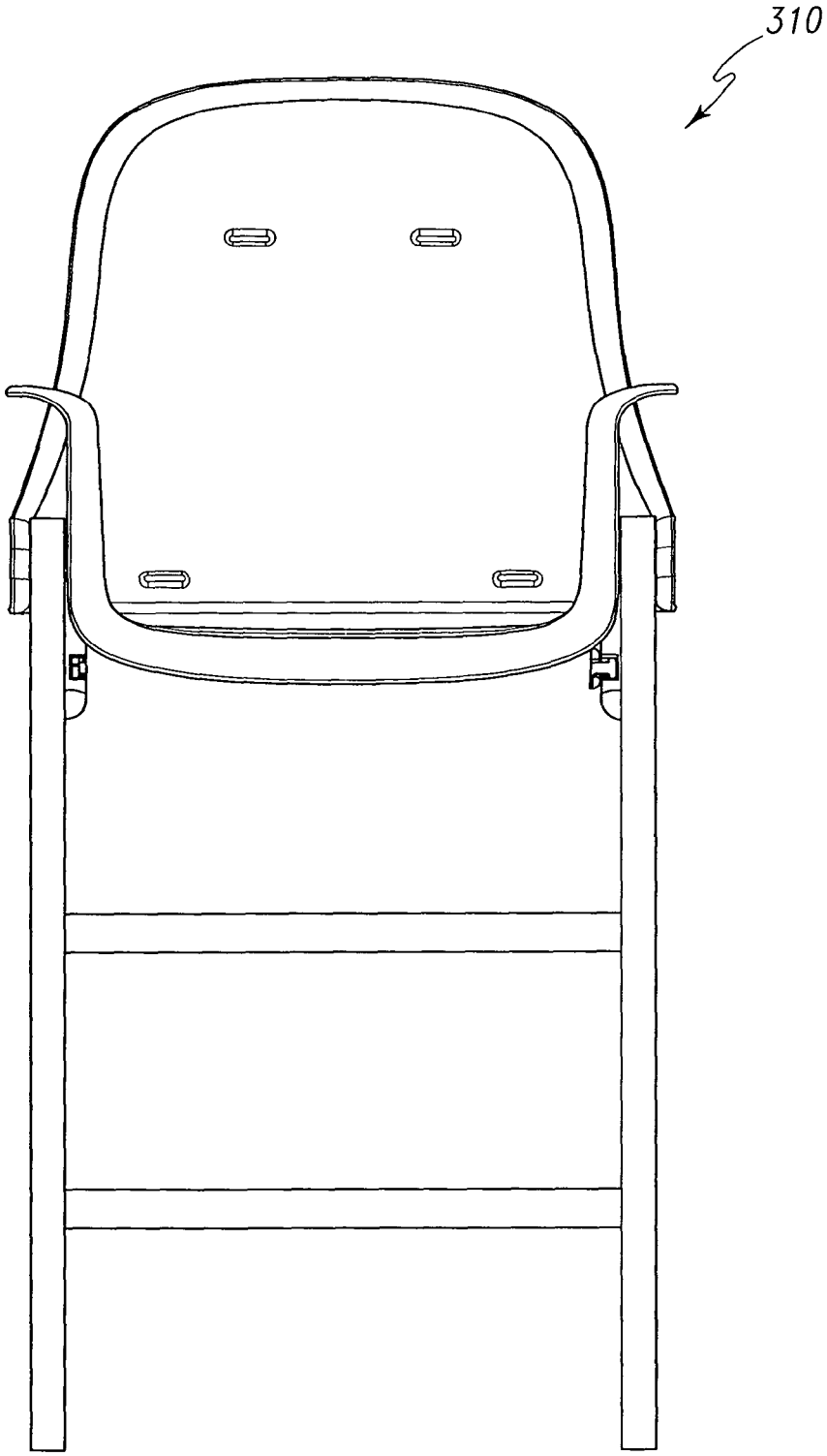
Figure 29:
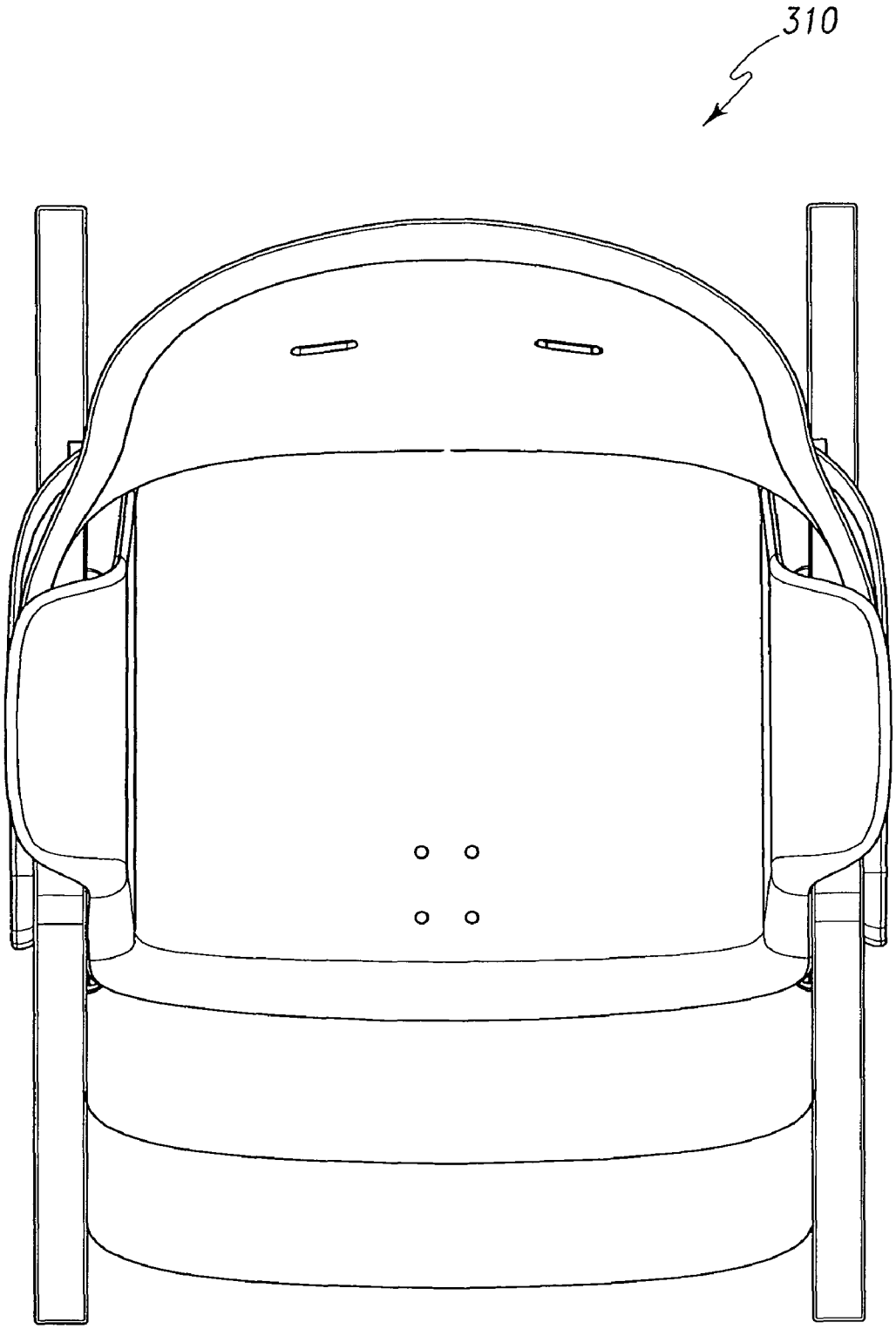
Figure 30:
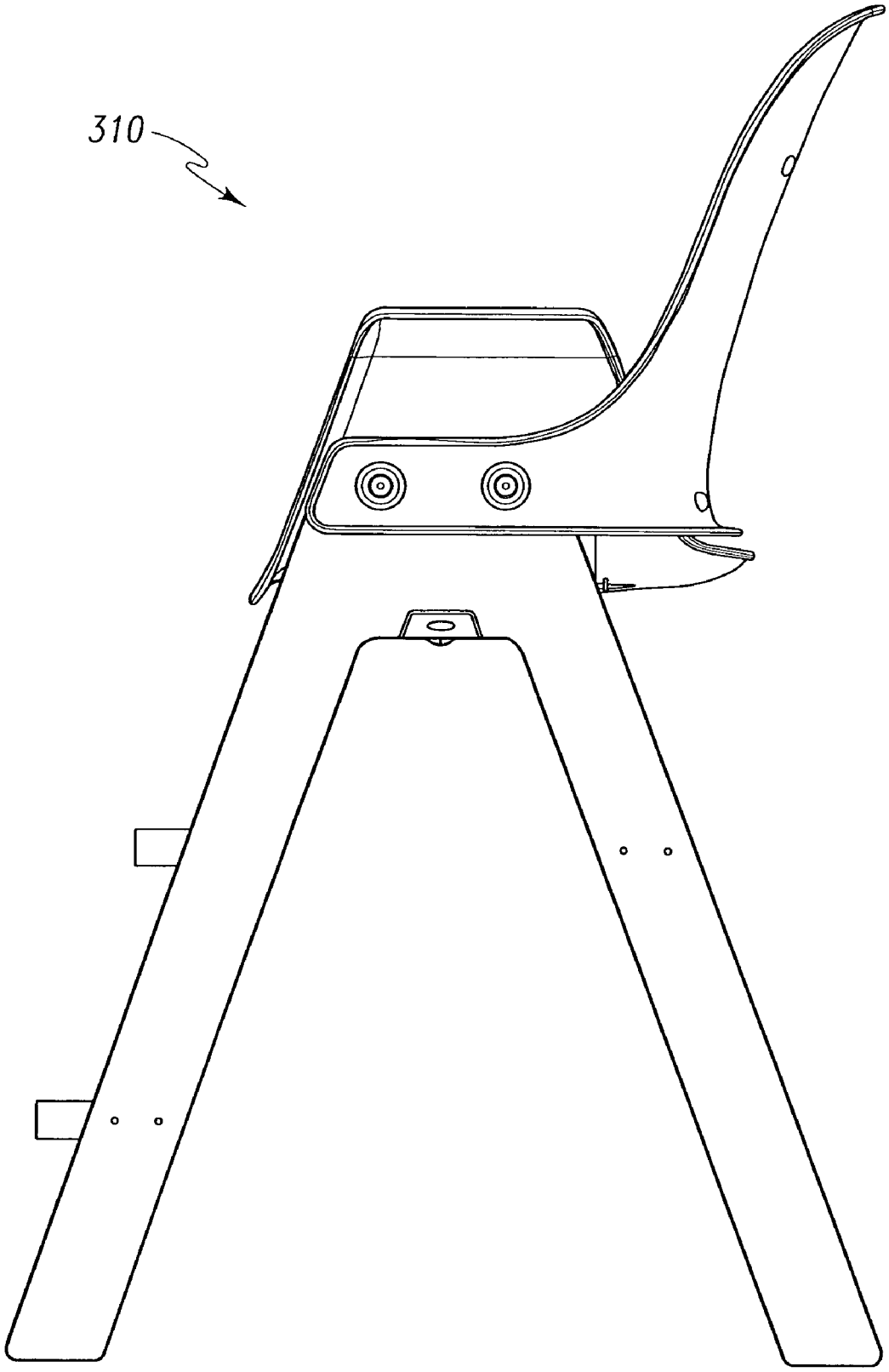
Figure 31:
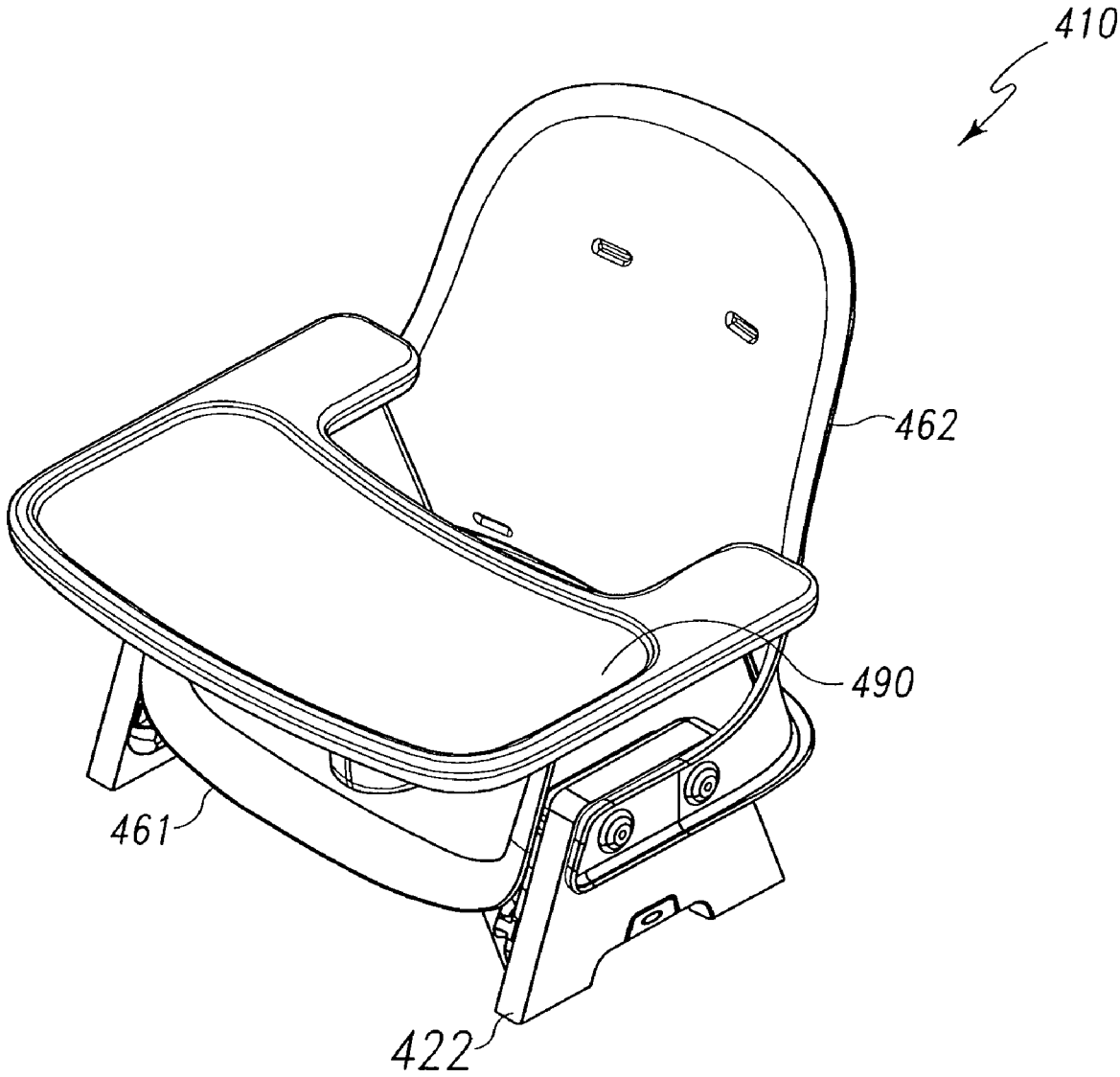
FIGS. 31-39 are various views of an embodiment of a booster seat in accordance with the present invention.
Figure 32:
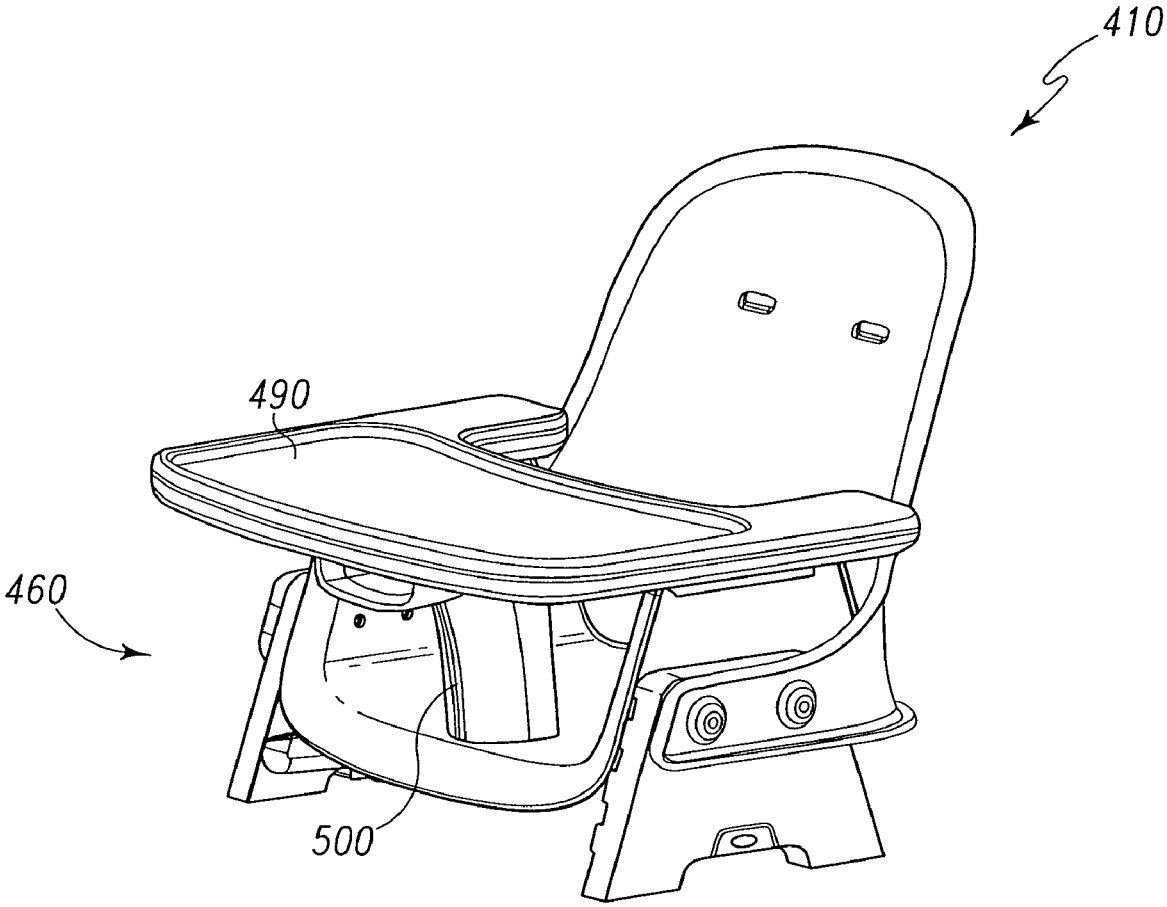
Figure 33:
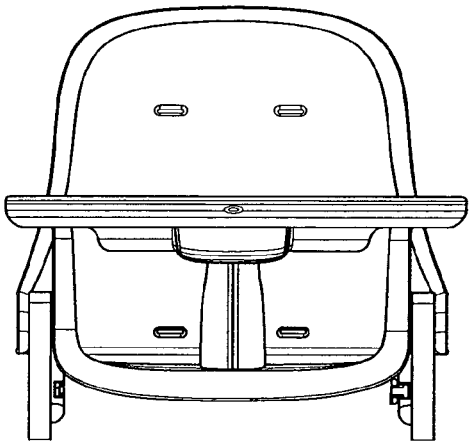
Figure 34:
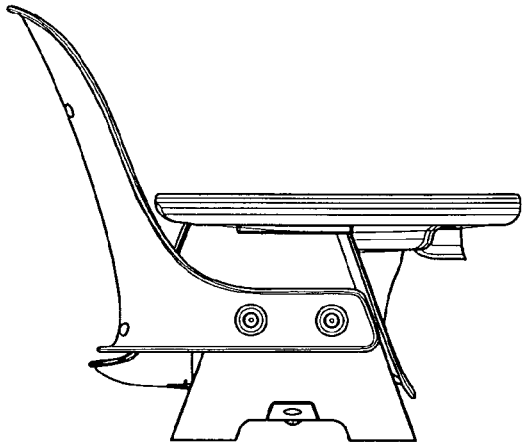
Figure 36:
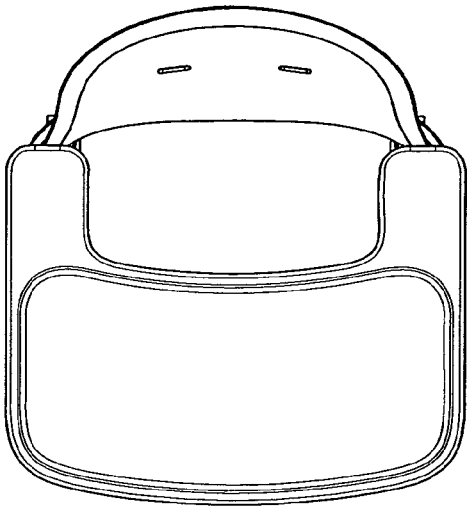
Figure 35:
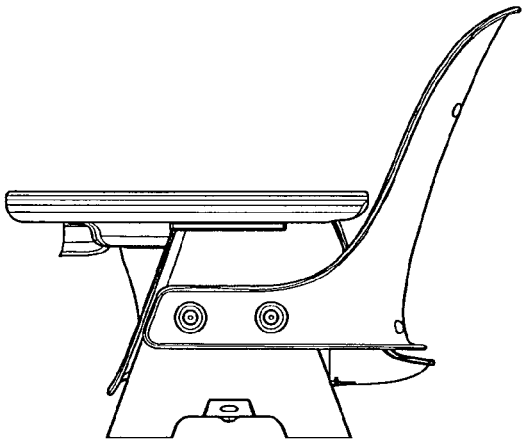
Figure 37:
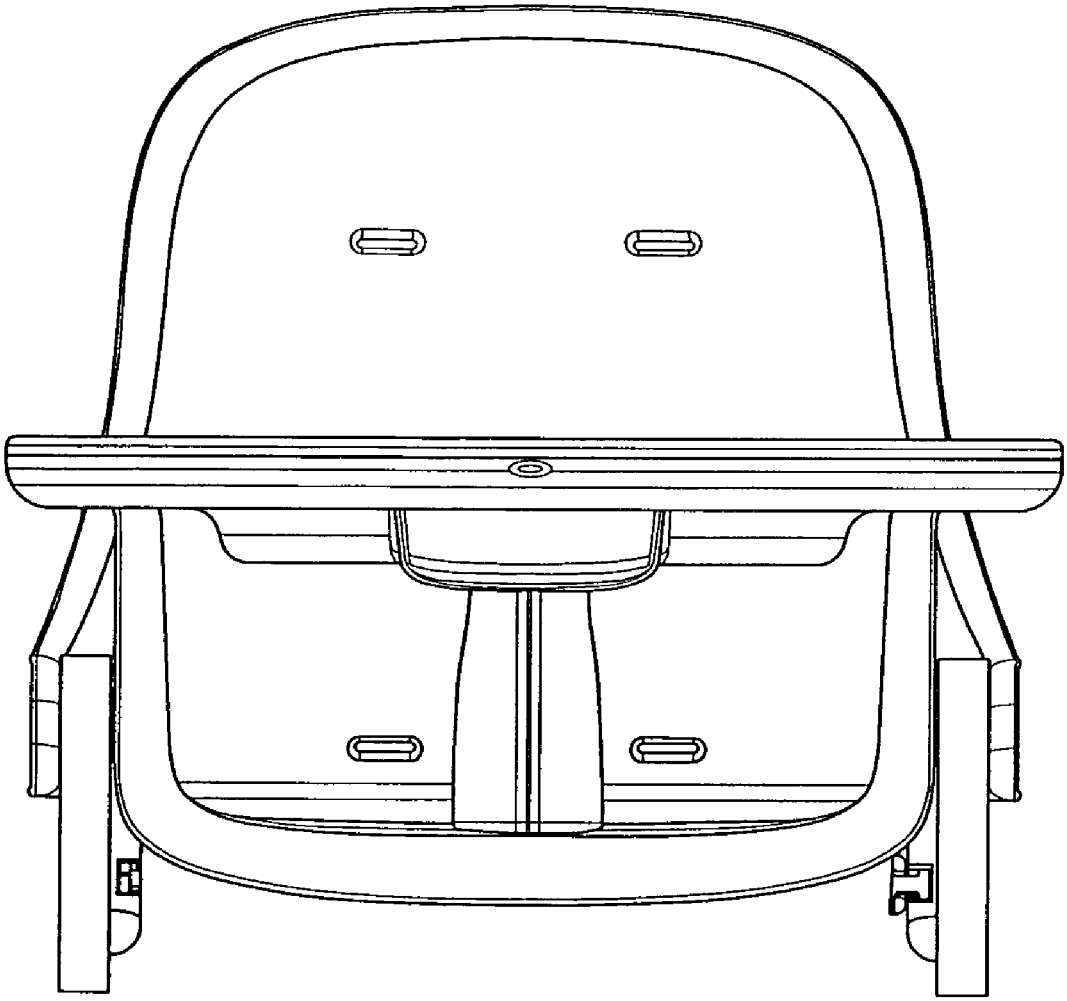
Figure 38:
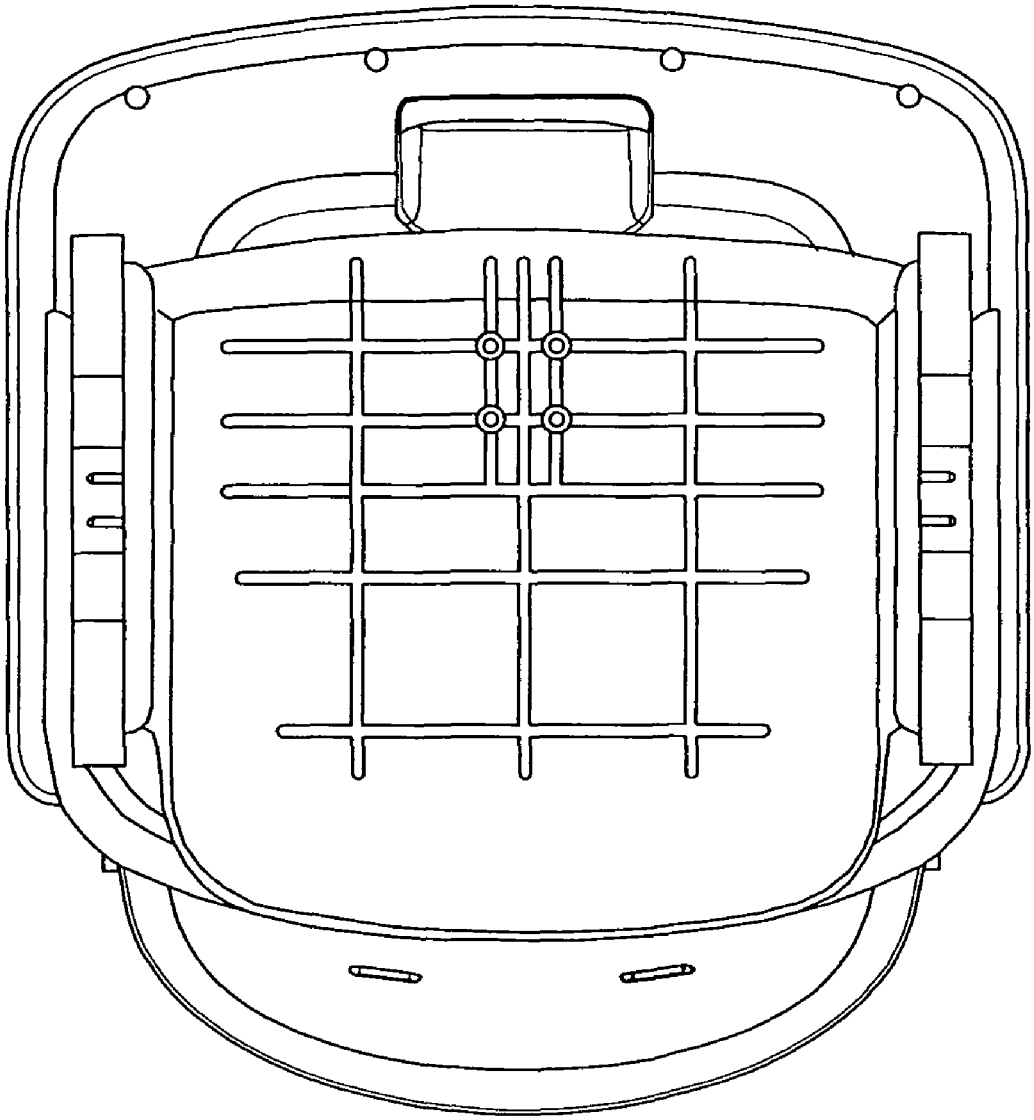
Figure 39:
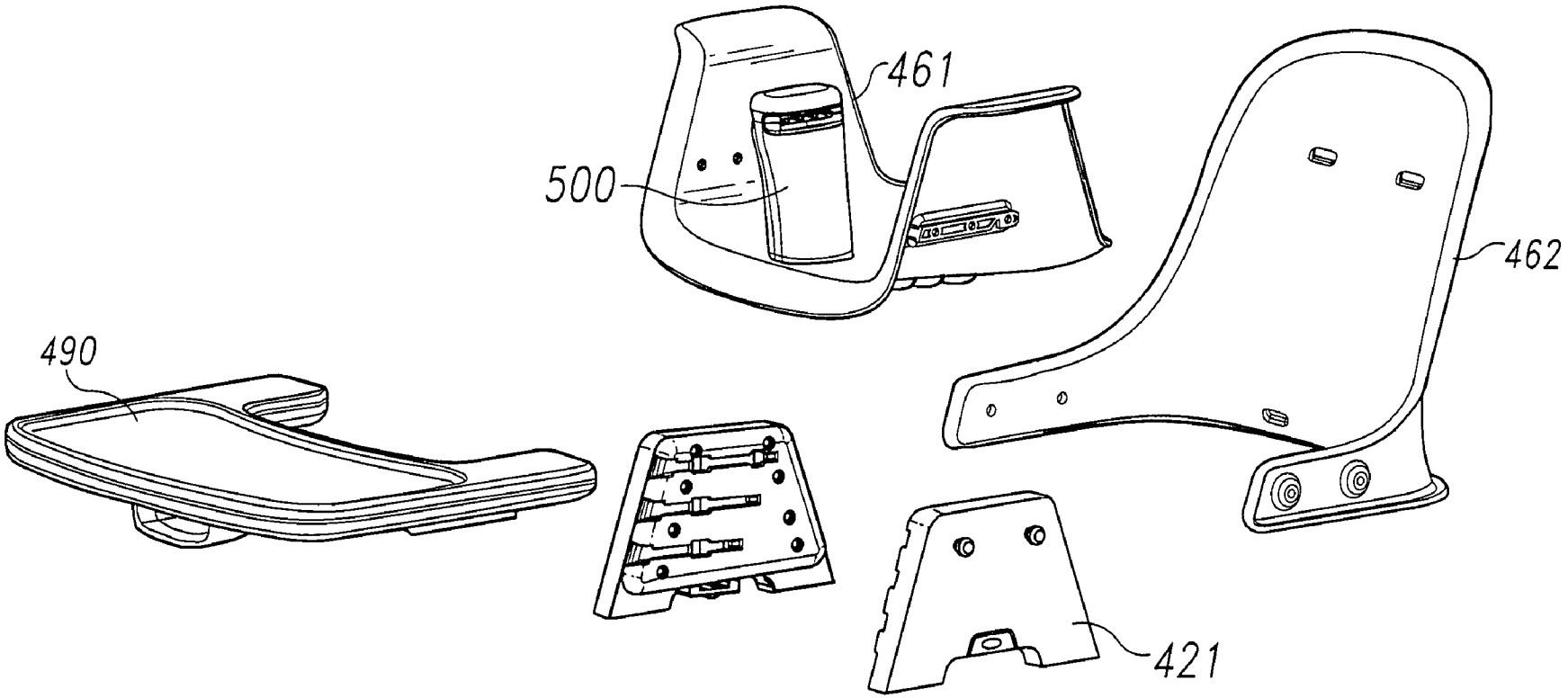

A preferred harness 120 of the disclosed highchair 10 is a five-point contact system, as shown in FIGS. 21 and 22. The five-points of contact include one at each shoulder (two total), one at each hip (two total) and one at the crotch. Four-, three- and two-point contact harnesses may be used, if desired. In the present embodiment, other than the center post attachment described above, the straps of the harness are threaded through the back support 62 of the seat at slots 122. Each of the straps is individually adjustable from behind the back support 62, instead of in front. This permits an adult to readily adjust the harness 120 to suit the seated child without the interference of the child's hands. The rear adjustment feature also prevents the adjustment devices from getting all sticky and messy, making adjustment much easier as well.

Additional Embodiments

Referring to FIGS. 23-30, additional embodiments of the present highchair 10 are shown. For example, FIGS. 23-26 illustrates an embodiment of the present highchair 210 without use of a tray. This highchair 210 may be used to seat small children at a separate table to eat, play or whatever. FIGS. 27-30 illustrates an embodiment of the highchair 310 having no center post and no tray. Like the previous embodiment, this highchair 310 may be suitable for use with a separate table or desk. However, without the center post, this highchair 310 may be best suited for older children not prone to slipping forward from the seat. Naturally, a suitable harness may be used with both highchair embodiments 210 and 310, if desired.

FIGS. 31-38 are directed to a final embodiment of the invention, booster seat 410. The disclosed booster seat 410 comprises a seat 460 having a center post 500, a tray 490, and a frame 420. The seat 460 is shown to include an adjustable bottom support 461, as described in detail above. The booster seat 410 differs most notably from the highchair 10 in that the frame 420 has significantly reduced legs 422. Accordingly, there are no frame supports or footrests provided with the booster seat 410. The adjustable tray 490 operates in conjunction with the center post 500 as described above for highchair 10.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A highchair comprising:

a seat having a bottom support and a back support, the bottom support including a fixed center post extending there from, wherein the center post includes a retention channel formed on a generally vertical side of the center post, wherein the retention channel includes a plurality of tray position notches;

a tray detachably coupled to the center post of the seat, wherein the tray includes a center post channel;

a tray latching mechanism for connecting the tray to the center post and capable of movement between a first connecting position, a second connecting position and a release position, wherein the tray latching mechanism includes pins adjacent a bottom surface of the tray and a handle adjacent the bottom surface of the tray and linked to the pins such that movement of the handle results in movement of the pins, wherein the pins are positioned in the center post channel and the tray is positioned on the center post by aligning the center post with the center post channel, wherein a respective pin is receivable in a respective tray position notch to prevent movement of the tray with respect to the center post;

a frame supporting the seat at a first position and having a footrest supported at a second position on the frame, wherein the bottom support of the seat and the footrest are independently adjustable between a plurality of fixed seat position channels on the frame and a plurality of fixed footrest position channels on the frame, respectively, wherein the seat position channels extend such that a rear-most end of each seat position channel terminates progressively forward moving top to bottom; and a harness for securing a child positioned in the seat, the harness being secured to the seat and adjustable for various sizes at a position adjacent a rear surface of the back support, the harness including a harness strap which is attached to the center post.

2. The highchair of claim 1, wherein the tray latching mechanism further comprises a single actuator for moving the tray between the first connecting position, the second connecting position and the release position.

3. The highchair of claim 1, further comprising a seat latching mechanism for retaining the seat at any of a plurality of fixed seat position channels on the frame.

4. The highchair of claim 3, wherein the seat latching mechanism comprises:

a slide bar positioned to intersect each of the fixed seat position channels and capable of movement along an axis between a lock position and a release position, wherein the seat is locked in a respective seat position channel when the slide bar is at the lock position and the seat is removable from the respective seat position channel when the slide bar is at the release position; and a button attached to an end of the slide bar and which moves along an axis, transverse to the axis of the slide bar, between a first and second position, wherein the slide bar is prevented from movement when the button is in the first position and is slidable between the slide bar lock and release positions when the button is in the second position.

5. A child seat comprising:

a seat having a bottom support and a back support;

a frame having a plurality of fixed seat position channels each configured to retain the bottom support therein, wherein the bottom support of the seat is vertically adjustable relative to the back support via the seat position channels, the frame further including a slide bar channel intersecting the seat position channels; and a seat latching mechanism for retaining the seat at any of the fixed seat position channels, the seat latching mechanism comprising:

a slide bar positioned in the slide bar channel intersecting each of the fixed seat position channels simultaneously and capable of movement along an axis between a lock position and a release position, wherein the seat is locked in one of the seat position channels when the slide bar is at the lock position and the seat is removable from the seat position channels when the slide bar is at the release position; and a button attached to an end of the slide bar and which moves along an axis, transverse to the axis of the slide bar, between a first and second position, wherein the slide bar is prevented from movement when the button is in the first position and is slidable between the slide bar lock and release positions when the button is in the second position.

6. The child seat of claim 5, wherein the button is flush with a surface of the frame when in the first position.

7. The child seat of claim 6, wherein the button is extended from the surface of the frame when in the second position.

8. The child seat of claim 5, wherein the slide bar comprises a number of stops corresponding to a number of the plurality of seat position channels and for engaging and retaining the seat in a seat position channel.

9. The child seat of claim 5, further comprising a fixed center post extending from the seat.

10. The child seat of claim 9, further comprising a tray detachably coupled to the center post.

11. The child seat of claim 10, wherein the tray comprises a latching mechanism for connecting the tray to the seat and capable of movement between a first connecting position, a second connecting position and a release position.

12. The child seat of claim 11, wherein the tray latching mechanism comprises a single actuator for moving the tray between the first connecting position, the second connecting position and the release position.

13. The child seat of claim 5, further comprising a footrest supported at a position on the frame, wherein the footrest is adjustable between a plurality of fixed footrest position channels on the frame.

14. The child seat of claim 13, wherein the footrest and seat are independently adjustable.

15. The child seat of claim 9, further comprising a harness for securing a child positioned in the seat, the harness being secured to the center post and the back support and the harness being adjustable for various sizes at a position adjacent a rear surface of the back support.

16. A chair comprising:

a seat having a bottom support and a back support;

a center post extending from the seat, the center post including a tray guide having a retention channel including a plurality of tray position notches;

a frame supporting the seat;

a tray detachably coupled to the center post;

a tray latching mechanism for detachably connecting the tray to the center post, and the latching mechanism being adjustable between an adjust setting where the tray is secured to the center post and capable of sliding movement between a plurality of latching points, a locked setting where the tray is secured at a respective latching point of the plurality of latching points and prevented from movement, and a release setting where the tray is released from attachment, wherein the tray latching mechanism includes a pin, wherein the pin is located in the retention channel when in the adjust setting and the in is located in one of the plurality of tray position notches when in the locked setting wherein the tray latching mechanism includes pins adjacent a bottom surface of the tray and a single release mechanism comprising a handle adjacent the bottom surface of the tray and linked to the pins such that movement of the handle results in movement of the pins; wherein the tray includes a center post channel, wherein the pins are positioned in the center post channel and the tray is positioned on the center post by aligning the center post with the center post channel; and wherein the center post includes a retention channel formed on a generally vertical side of the center post, wherein the retention channel includes a plurality of tray position notches, wherein a respective pin is receivable in a respective tray position notch to prevent movement of the tray with respect to the center post.

17. The chair of claim 16, wherein the tray latching mechanism comprises an actuator for moving the latching mechanism between the settings.

18. The chair of claim 17, wherein the actuator is a single handle attached to the tray.

* * * * *

UNITED STATES PATENT AND TRADEMARK OFFICE

CERTIFICATE OF CORRECTION

PATENT NO. : 8,240,765 B2
APPLICATION NO. : 12/584727
DATED : August 14, 2012
INVENTOR(S) : Kennedy et al.

It is certified that error appears in the above-identified patent and that said Letters Patent is hereby corrected as shown below:

In Column 10, Line 53, (Claim 16, line 19) delete "in" (second occurrence), insert --pin--

Signed and Sealed this
Twenty-fifth Day of September, 2012

David J. Kappos

David J. Kappos
*Director of the United States Patent and Trademark Office*